US012473165B2

(12) United States Patent
Matsumoto

(10) Patent No.: US 12,473,165 B2
(45) Date of Patent: Nov. 18, 2025

(54) SHEET CONVEYANCE APPARATUS AND IMAGE FORMING APPARATUS

(71) Applicant: CANON KABUSHIKI KAISHA, Tokyo (JP)

(72) Inventor: Yasuaki Matsumoto, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 185 days.

(21) Appl. No.: 18/125,919

(22) Filed: Mar. 24, 2023

(65) Prior Publication Data

US 2023/0322512 A1 Oct. 12, 2023

(30) Foreign Application Priority Data

Apr. 8, 2022 (JP) ..... 2022-064386

(51) Int. Cl.

| | |
|---|---|
| ***B65H 9/00*** | (2006.01) |
| ***B65H 5/02*** | (2006.01) |
| ***B65H 5/06*** | (2006.01) |
| ***B65H 5/38*** | (2006.01) |

(52) U.S. Cl.

CPC ..... *B65H 9/004* (2013.01); *B65H 5/025* (2013.01); *B65H 5/068* (2013.01); *B65H 5/38* (2013.01); *B65H 2801/06* (2013.01)

(58) Field of Classification Search

CPC ..... B65H 9/004; B65H 5/36

See application file for complete search history.

(56) References Cited

U.S. PATENT DOCUMENTS

| | | | |
|---|---|---|---|
| 7,900,914 | B2 | 3/2011 | Fujita et al. |
| 8,205,879 | B2 | 6/2012 | Fujita et al. |
| 8,342,519 | B2 | 1/2013 | Watanabe et al. |

(Continued)

FOREIGN PATENT DOCUMENTS

| | | | |
|---|---|---|---|
| JP | 2015-030571 | A | 2/2015 |
| JP | 2017-057085 | A | 3/2017 |

(Continued)

OTHER PUBLICATIONS

European Search Report mailed Dec. 27, 2023, in European Patent Application No. 23165431.0.

(Continued)

*Primary Examiner* — Howard J Sanders

(74) *Attorney, Agent, or Firm* — VENABLE LLP

(57) ABSTRACT

A sheet conveyance apparatus includes a conveyance rotating member pair to convey a sheet in a sheet conveyance direction, and a skew correction portion including a first abutment surface having a first root portion and a second abutment surface having a second root portion. A guide portion includes a guide surface disposed between the first abutment surface and the second abutment surface. The first root portion is positioned within a first recess portion disposed upstream of the first abutment surface such that a leading edge of the sheet enters the first recess portion upon abutting against both the first abutment surface and the second abutment surface, and the second root portion is positioned within a second recess portion such that the leading edge of the sheet enters the second recess portion upon abutting against both the first abutment surface and the second abutment surface.

18 Claims, 17 Drawing Sheets

(56) References Cited

U.S. PATENT DOCUMENTS

| | | | | |
|---|---|---|---|---|
| 8,585,049 | B2 | 11/2013 | Fujita et al. | |
| 8,616,548 | B2 | 12/2013 | Watanabe et al. | |
| 8,973,918 | B2 | 3/2015 | Muramatsu et al. | |
| 8,991,819 | B2 | 3/2015 | Watanabe et al. | |
| 9,193,546 | B2 * | 11/2015 | Nakamura | B65H 5/36 |
| 9,327,930 | B2 | 5/2016 | Watanabe et al. | |
| 9,796,550 | B2 | 10/2017 | Watanabe et al. | |
| 9,868,600 | B2 | 1/2018 | Oya et al. | |
| 10,106,355 | B2 | 10/2018 | Sato | |
| 10,207,883 | B2 | 2/2019 | Inoue | |
| 10,273,100 | B2 | 4/2019 | Oya et al. | |
| 10,577,207 | B2 | 3/2020 | Sato | |
| 10,662,013 | B2 | 5/2020 | Watanabe et al. | |
| 11,447,354 | B2 | 9/2022 | Watanabe et al. | |
| 2017/0029231 | A1 | 2/2017 | Iwami et al. | |
| 2018/0009617 | A1 | 1/2018 | Watanabe et al. | |
| 2018/0282093 | A1 | 10/2018 | Matsui et al. | |
| 2020/0369484 | A1 | 11/2020 | Suzuki et al. | |

FOREIGN PATENT DOCUMENTS

| | | | |
|---|---|---|---|
| JP | 2017-190198 | A | 10/2017 |
| JP | 2018-002461 | A | 1/2018 |
| KR | 20090067079 | A | 6/2009 |
| KR | 20140083899 | A | 7/2014 |
| KR | 20170030055 | A | 3/2017 |
| KR | 20170074196 | A | 6/2017 |
| WO | 2011/048668 | A1 | 4/2011 |

OTHER PUBLICATIONS

Korean Office Action dated Nov. 25, 2024, in related Korean Patent Application No. 10-2023-0045801.

Korean Notice of Allowance dated May 27, 2025, in related Korean Patent Application No. 10-2023-0045801.

* cited by examiner

SHEET CONVEYANCE APPARATUS AND IMAGE FORMING APPARATUS

BACKGROUND OF THE INVENTION

Field of the Invention

The present invention relates to a sheet conveyance apparatus that conveys a sheet and an image forming apparatus including the same.

Description of the Related Art

In the related art, there has been proposed an image forming apparatus that corrects a skew of a sheet by forming a loop on the sheet by abutting a leading edge of the sheet conveyed by a pre-registration roller pair against a nip portion of a registration roller pair that is stopping rotation (see JP 2017-190198 A). The image forming apparatus includes a separating unit for separating the pre-registration roller pair from each other.

The sheet subjected to the skew correction is conveyed toward the secondary transfer portion by the pre-registration roller pair, and at this time, a force for returning the skew is generated in the sheet by the loop reaction force. Therefore, the image forming apparatus reduces the loop pressure generated in the sheet by separating (releasing) the nip portion of the pre-registration roller pair.

However, the image forming apparatus described in JP 2017-190198 A causes the pre-registration roller pair to abut against each other again after releasing the nip portion of the pre-registration roller pair. At this time, the orientation of the sheet may not be stable, and conveyance failure such as slip may occur in the pre-registration roller pair.

SUMMARY OF THE INVENTION

According to a first aspect of the present invention, a sheet conveyance apparatus includes a conveyance rotating member pair configured to convey a sheet in a sheet conveyance direction, a skew correction portion including a first abutment portion against which a leading edge of the sheet conveyed by the conveyance rotating member pair abuts, and a second abutment portion that is disposed at a position different from the first abutment portion in a width direction orthogonal to the sheet conveyance direction and corrects a skew of the sheet in a case where the leading edge of the sheet abuts against the second abutment portion together with the first abutment portion, and a guide portion that guides the sheet conveyed by the conveyance rotating member pair toward the first abutment portion and the second abutment portion. The guide portion includes a guide surface that is disposed between the first abutment portion and the second abutment portion in the width direction and forms a conveyance path through which a sheet passes, a first recess portion that is disposed upstream of the first abutment portion in the sheet conveyance direction, is disposed at a position overlapping with the first abutment portion in the width direction, and is recessed to an opposite side to the conveyance path with respect to the guide surface, and a second recess portion that is disposed upstream of the second abutment portion in the sheet conveyance direction, is disposed at a position overlapping with the second abutment portion in the width direction, and is recessed to an opposite side to the conveyance path with respect to the guide surface.

According to a second aspect of the present invention, a sheet conveyance apparatus includes a conveyance rotating member pair configured to convey a sheet in a sheet conveyance direction, a skew correction portion including a first rotating member pair having a first nip against which a leading edge of the sheet conveyed by the conveyance rotating member pair abuts, and a second rotating member pair disposed at a position different from the first rotating member pair in a width direction orthogonal to the sheet conveyance direction and having a second nip that corrects a skew of the sheet in a case where the leading edge of the sheet abuts against the second nip together with the first nip, and a guide portion that guides the sheet conveyed by the conveyance rotating member pair toward the first nip and the second nip. The guide portion includes a guide surface that forms a conveyance path through which a sheet passes, and a recess portion that is disposed upstream of the first nip and the second nip in the sheet conveyance direction and between the first nip and the second nip in the width direction, and is recessed to an opposite side to the conveyance path with respect to the guide surface.

According to a third aspect of the present invention, a sheet conveyance apparatus includes a conveyance rotating member pair configured to convey a sheet in a sheet conveyance direction, a skew correction portion including an abutment portion that corrects a skew of a sheet in a case where a leading edge of the sheet conveyed by the conveyance rotating member pair abuts against the skew correction portion, and a guide portion that guides the sheet conveyed by the conveyance rotating member pair toward the abutment portion. The guide portion includes a first guide surface that is disposed on a first side with respect to the abutment portion in a width direction orthogonal to the sheet conveyance direction and forms a conveyance path through which the sheet passes, a second guide surface that is disposed on a second side with respect to the abutment portion in the width direction and forms the conveyance path, and a recess portion that is disposed upstream of the abutment portion in the sheet conveyance direction, is disposed at a position overlapping with the abutment portion in the width direction, and is recessed to an opposite side to the conveyance path with respect to the first guide surface and the second guide surface.

Further features of the present invention will become apparent from the following description of exemplary embodiments with reference to the attached drawings.

DESCRIPTION OF THE EMBODIMENTS

First Embodiment

Overall Configuration

First, a first embodiment of the present invention will be described. A printer 1 as an image forming apparatus is an electrophotographic laser beam printer that forms a monochrome toner image. In the following description, a sheet S is a sheet on which an image is formed by the printer 1, and includes, for example, paper, an overhead transparency (OHT) sheet, and the like.

Figure 1:
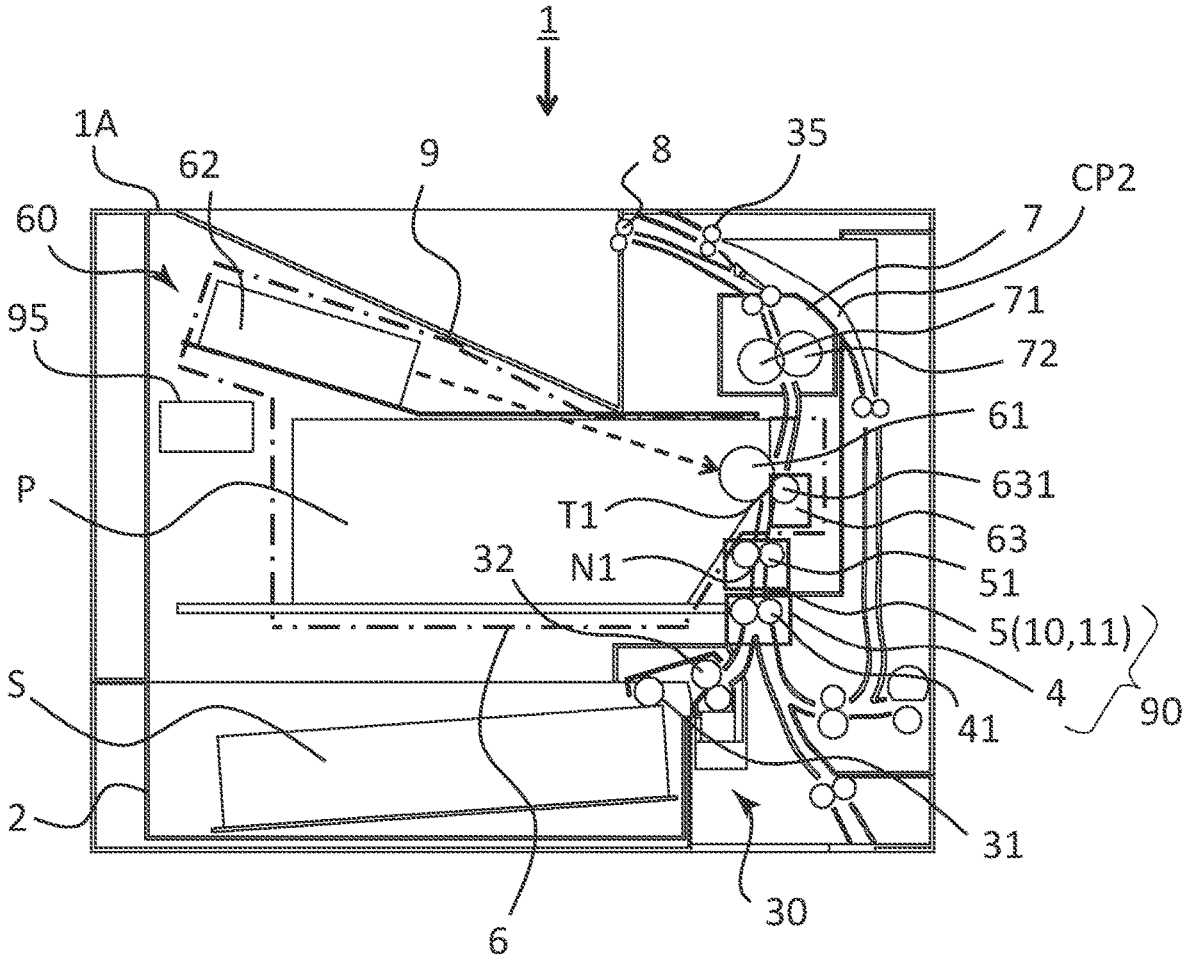
FIG. 1 is an overall schematic view illustrating a printer according to a first embodiment.

As illustrated in FIG. 1, the printer 1 includes a feeding unit 30 that feeds stacked sheets, a sheet conveyance apparatus 90 that conveys the sheets, an image forming unit 60 that forms an image on the sheets fed by the feeding unit 30, and a control unit 95. The printer 1 further includes a fixing device 7 that fixes the image transferred to the sheet, and a discharge roller pair 8 that can discharge the sheet to a discharge tray 9.

When an image forming job is output to the printer 1, the image forming process by the image forming unit 60 is started on the basis of image information input from an external computer or the like connected to the printer 1. The image forming unit 60 as an image forming unit includes a laser scanner 62, a process cartridge P having a photosensitive drum 61, and a transfer roller 631. A charging roller, a developing roller, and the like (not illustrated) are provided around the photosensitive drum 61. The photosensitive drum 61 and the transfer roller 631 form a transfer nip T1.

The laser scanner 62 irradiates the photosensitive drum 61 with laser light on the basis of the input image information. At this time, the photosensitive drum 61 is charged in advance by a charging roller, and an electrostatic latent image is formed on the photosensitive drum 61 by being irradiated with laser light. Thereafter, the electrostatic latent image is developed by the developing roller, and a monochrome toner image is formed on the photosensitive drum 61.

In parallel with the above-described image forming process, the sheet S is fed from the feeding unit 30. The feeding unit 30 includes a cassette 2 that can be pulled out and attached to an apparatus body 1A of the printer 1, a feeding roller 31, and a separation roller pair 32. The sheet S stored in the cassette 2 is fed by a feeding roller 31, and the sheet S fed by the feeding roller 31 is separated one by one by the separation roller pair 32.

Note that the cassette 2 may be provided with an intermediate plate that can support and lift a sheet, and for example, the intermediate plate may be raised by receiving an image forming job, and the sheet supported by the intermediate plate and the feeding roller may be brought into contact with each other. In the separation roller pair 32, one of the roller pair may be a pad or the like, and a torque limiter method, a retard roller method, or the like can be applied.

The toner image on the photosensitive drum 61 is transferred to the sheet S fed from the feeding unit 30 and conveyed by the sheet conveyance apparatus 90 at the transfer nip T1 by the electrostatic load bias applied to the transfer roller 631. The remaining toner remaining on the photosensitive drum 61 is collected by a cleaning blade (not illustrated). Predetermined heat and pressure are applied to the sheet S to which the toner image has been transferred by a fixing film 71 and a pressure roller 72 of the fixing device 7, and the toner is melted and fixed. A heating member such as a ceramic heater is disposed inside of the fixing film 71. The sheet S having passed through the fixing device 7 is discharged to the discharge tray 9 by the discharge roller pair 8.

When images are formed on both surfaces of the sheet S, the sheet S on which the images are formed on the first surface is switched back by a reverse conveyance roller pair 35 and conveyed to a duplex conveyance path CP2. The sheet S conveyed through the duplex conveyance path CP2 is conveyed again to the transfer nip T1 by the sheet conveyance apparatus 90, and an image is formed on the second surface at the transfer nip T1 and discharged to the discharge tray 9.

Sheet Conveyance Apparatus

Next, the sheet conveyance apparatus 90 will be described with reference to FIGS. 1 to 3. As illustrated in FIG. 1, the sheet conveyance apparatus 90 includes a conveyance unit 4 and a registration unit 5. The conveyance unit 4 includes a conveyance roller pair 41 serving as a conveyance rotating member pair that conveys the sheet S conveyed by the separation roller pair 32 to the registration unit 5.

Figure 2:
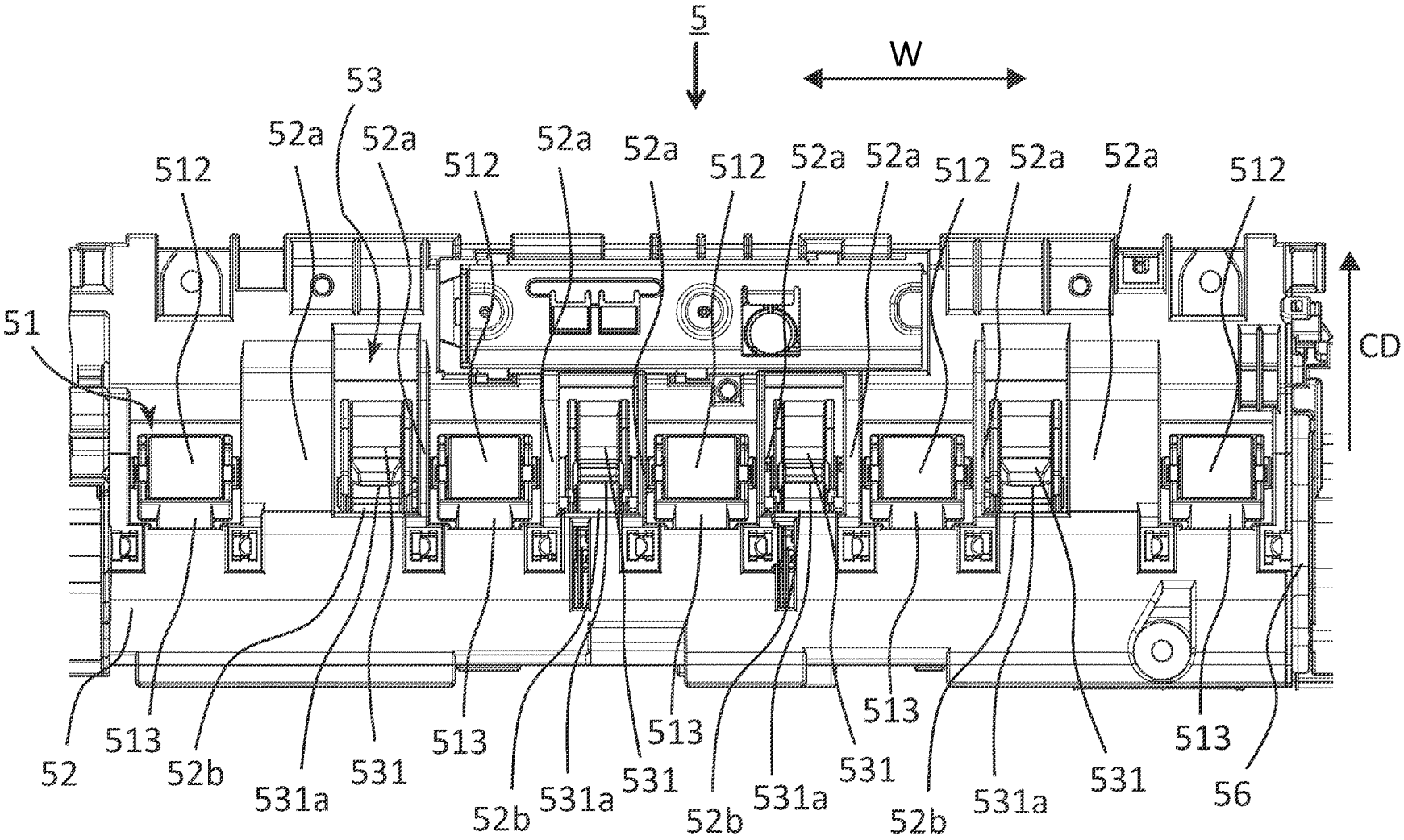
FIG. 2 is a front view illustrating a registration unit.
Figure 3:
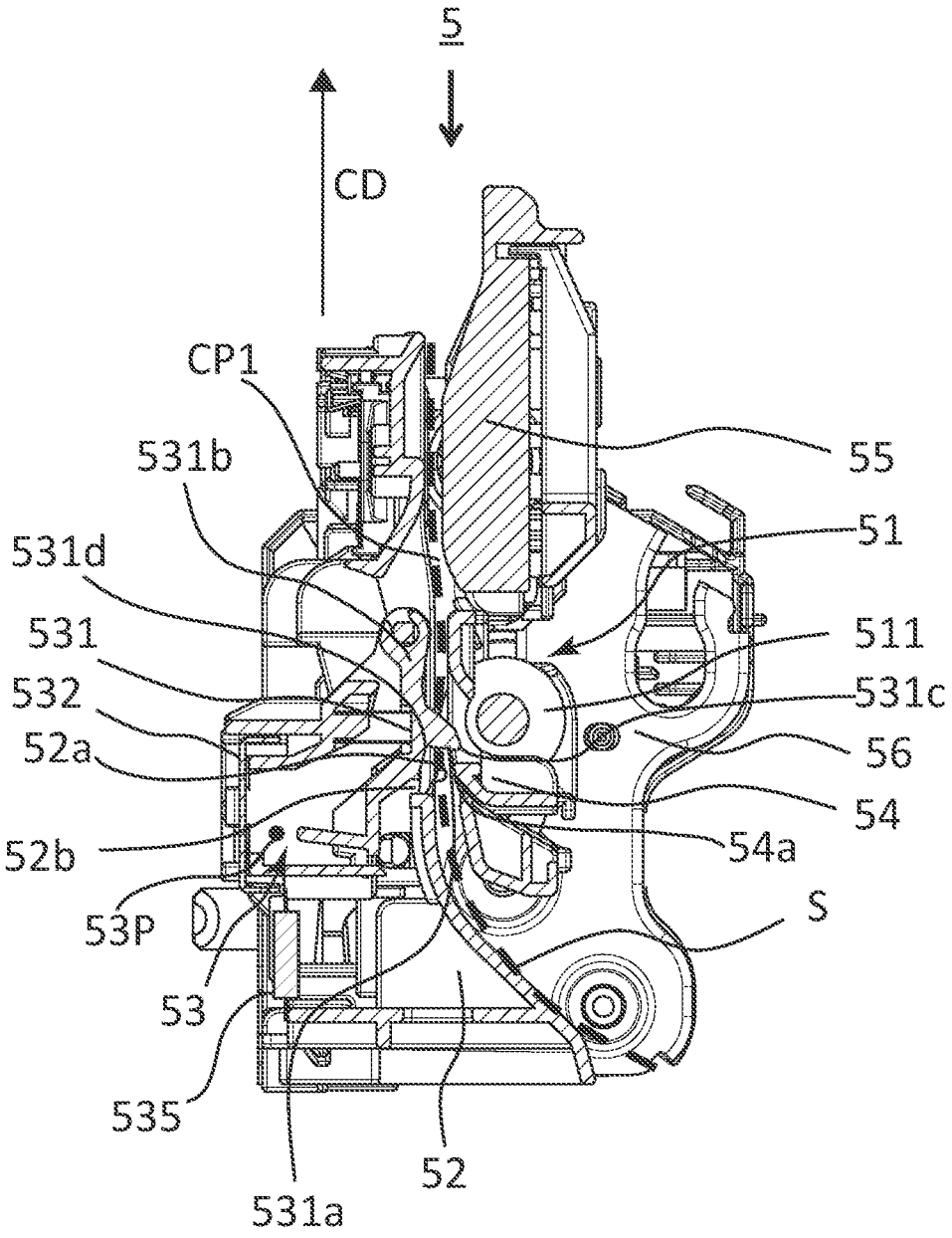
FIG. 3 is a cross-sectional view illustrating a registration unit.

As illustrated in FIGS. 2 and 3, the registration unit 5 includes a plurality of registration roller pairs 51, a registration frame 52, an opposing guide 54, a downstream guide 55, and a skew correction unit 53. The registration frame 52, the opposing guide 54, and the downstream guide 55 form a conveyance path CP1 through which the sheet S passes, and the sheet S is conveyed to the transfer nip T1 through a conveyance path CP1. The opposing guide 54 and the downstream guide 55 are held by the registration frame 52 and a side plate 56.

In the present embodiment, five registration roller pairs 51 are arranged side by side in the width direction W orthogonal to a sheet conveyance direction CD. The registration roller pair 51 as a rotating member pair includes a registration roller 511 and a registration driven roller 512. The registration roller 511 and the registration driven roller 512 form a conveyance nip N1 (see FIG. 1) for conveying the sheet S. A plurality of (five in the present embodiment) registration holders 513 are swingably supported by the registration frame 52 as a guide portion, and the registration holders 513 rotatably support the registration rollers 512. A spring (not illustrated) is disposed between the registration holder 513 and the registration frame 52, and the registration driven roller 512 is pressed against the registration roller 511 by the spring.

Skew Correction Unit

Next, the skew correction unit 53 will be described with reference to FIGS. 2 to 5. As illustrated in FIGS. 2 and 3, the skew correction unit 53 as a skew correction portion includes a plurality of skew correction members 531 and a connecting member 532 that connects the skew correction members 531. In the present embodiment, four skew correction members 531 are arranged side by side in the width direction W, and each skew correction member 531 is disposed so as to be sandwiched between two registration roller pairs 51 in the width direction W. That is, the registration roller pair 51 and the skew correction member 531 are alternately arranged in the width direction W. Two skew correction members 5 among four skew correction members 531 are a first abutment member and a second abutment member, respectively.

Further, the registration frame 52 has a plurality of guide surfaces 52*a* which are provided to be spaced apart from each other in the width direction W and form the conveyance path CP1, and the skew correction member 531 and the registration driven roller 512 are arranged in the gaps between the guide surfaces 52*a*. Therefore, the guide surface 52*a* is disposed between the skew correction member 531 and the registration driven roller 512. The guide surfaces 52*a* are disposed so as to overlap each other when viewed in the width direction W.

The skew correction unit 53 is swingably supported with respect to the registration frame 52 about a swing shaft 53P, and is positioned at a standby position illustrated in FIG. 3 by a stopper (not illustrated) and a tension spring 535. That is, the plurality of skew correction members 531 and the connecting member 532 integrally swing about the swing shaft 53P. The position of the skew correction member 531 at this time is also referred to as a standby position. The skew correction unit 53 is biased clockwise in FIG. 3 about the swing shaft 53P by a tension spring 535. The skew correction member 531 includes a main body portion 531*b* and a sheet contact surface 531*a* that extends from the main body portion 531*b* and can be brought into contact with the leading edge of the sheet S passing through the conveyance path CP1.

The sheet contact surface 531*a* protrudes to the conveyance path CP1 when the skew correction member 531 is located at the contact position, and is disposed upstream of the conveyance nip N1 of the registration roller pair 51 in the sheet conveyance direction CD. At this time, the sheet contact surface 531*a* serving as an inclined surface is inclined upstream in the sheet conveyance direction CD toward the leading edge of the sheet contact surface, that is, away from the main body portion 531*b* when viewed in the width direction W. In other words, the sheet contact surface 531*a* is inclined so as to approach a recess portion 52*b* described below in the thickness direction of the sheet as the sheet contact surface 531*a* extends downstream in the sheet conveyance direction CD when viewed in the width direction. When viewed in the width direction W, a leading edge 531*c* of the sheet contact surface 531*a* is located more inward of the opposing guide 54 than the opposing guide surface 54*a*, and the root portion 531*d* of the sheet contact surface 531*a* is located inside of the registration frame 52 with respect to the guide surface 52*a*. The opposing guide surface 54*a* of the opposing guide 54, serving as the opposing guide portion, and the guide surface 52*a* form a part of the conveyance path CP1.

More specifically, in the registration frame 52, a recess portion 52*b* is formed at a position overlapping each skew correction member 531 in the width direction W, and the recess portion 52*b* is recessed to an opposite side to the conveyance path CP1 with respect to the guide surface 52*a*. A root portion 531*d* of the sheet contact surface 531*a* enters the inside of the recess portion 52*b*. The recess portion 52*b* at least extends upstream from a position overlapping with the root portion 531*d* of the sheet contact surface 531*a* in the sheet conveyance direction CD, but may also extend downstream from a position overlapping with the root portion 531*d*. Note that the recess portion 52*b* may have any configuration such as a hole, an opening, and a groove as long as the recess portion is formed such that the space communicates with the inside of the registration frame 52 more than the guide surface 52*a* when viewed in the width direction W.

In addition, among the sheet contact surfaces 531*a* of the plurality of skew correction members 531, the sheet contact surface arranged on an outer side of the conveyance path CP1 in the width direction W is located closer to the upstream in the sheet conveyance direction CD than the sheet contact surface arranged on an inner side of the conveyance path CP1. In the present embodiment, since the four skew correction members 531 are provided, the two sheet contact surfaces 531*a* arranged on the outer side in the width direction W are referred to as a third abutment portion and a fourth abutment portion. At this time, the third abutment portion and the fourth abutment portion are located upstream of the two sheet contact surfaces 531 *a* as the first abutment portion and the second abutment portion disposed inside in the width direction W in the sheet conveyance direction CD.

Figure 4A:
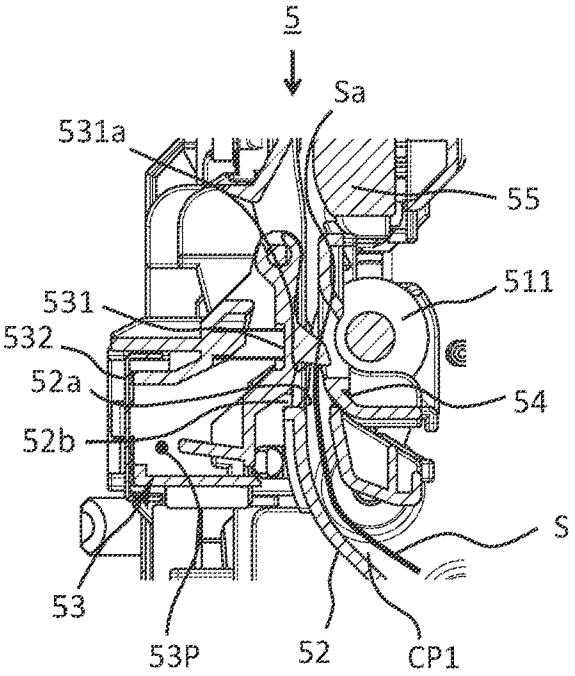
FIG. 4A is a cross-sectional view illustrating a state in which a leading edge of a sheet abuts a sheet contact surface.

Next, the operation of the skew correction unit 53 will be described with reference to FIGS. 4A to 5. As illustrated in FIG. 4A, the sheet S conveyed by the conveyance unit 4 enters the registration unit 5 along the conveyance path CP1. Then, the leading edge Sa of the sheet S abuts on any sheet contact surface 531*a* of the plurality of skew correction members 531 located at the standby position.

At this time, when the sheet S is conveyed in a skewed state, the leading edge of the sheet S on the leading side in the width direction W first comes into contact with the sheet contact surface 531*a*. Then, the sheet S turns about the contact portion with the sheet contact surface 531*a* that abuts first, and also abuts on the sheet contact surface 531*a* of the other skew correction member 531.

Figure 4B:
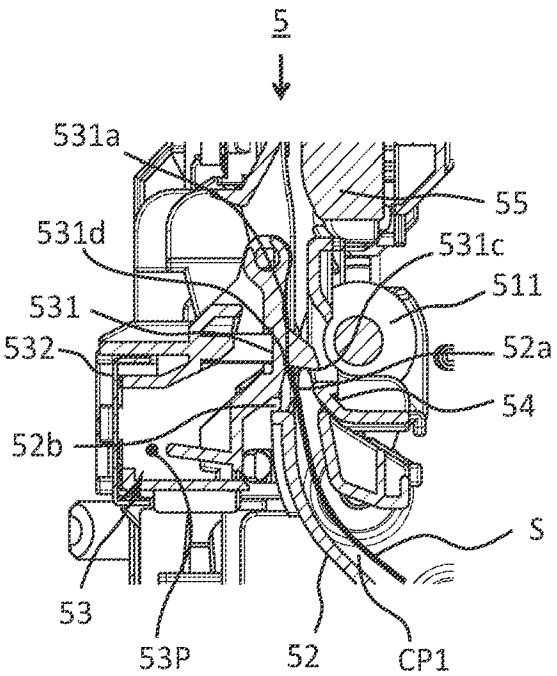
FIG. 4B is a cross-sectional view illustrating a state in which the leading edge of the sheet moves to a root portion of the sheet contact surface.

As illustrated in FIG. 4B, the sheet contact surface 531*a* is inclined toward the downstream in the sheet conveyance direction CD from the leading edge 531*c* toward the root portion 531*d*. Therefore, the leading edge Sa, abutting on the sheet contact surface 531*a*, of the sheet S is guided toward the root portion 531*d*. Therefore, the leading edge Sa of the sheet S moves toward the root portion 531*d* while turning. The skew of the sheet S is corrected by the leading edge Sa of the sheet S abutting on at least two sheet contact surfaces 531*a* among the sheet contact surfaces 531*a* of the plurality of (four) skew correction members 531. At the time when the skew of the sheet S is corrected, the biasing force of the tension spring 535 as the biasing portion for holding the skew correction unit 53 at the standby position is larger than the pressing force with which the sheet S presses the sheet contact surface 531*a*.

As described above, the recess portion 52*b* is formed at a position overlapping with the skew correction member 531 of the registration frame 52 in the width direction W. Therefore, the leading edge Sa of the sheet S whose skew has been corrected has a region abutting on the guide surface 52*a* and a region entering the recess portion 52*b*, and these regions are different in position from each other in the thickness direction of the sheet.

Figure 5:
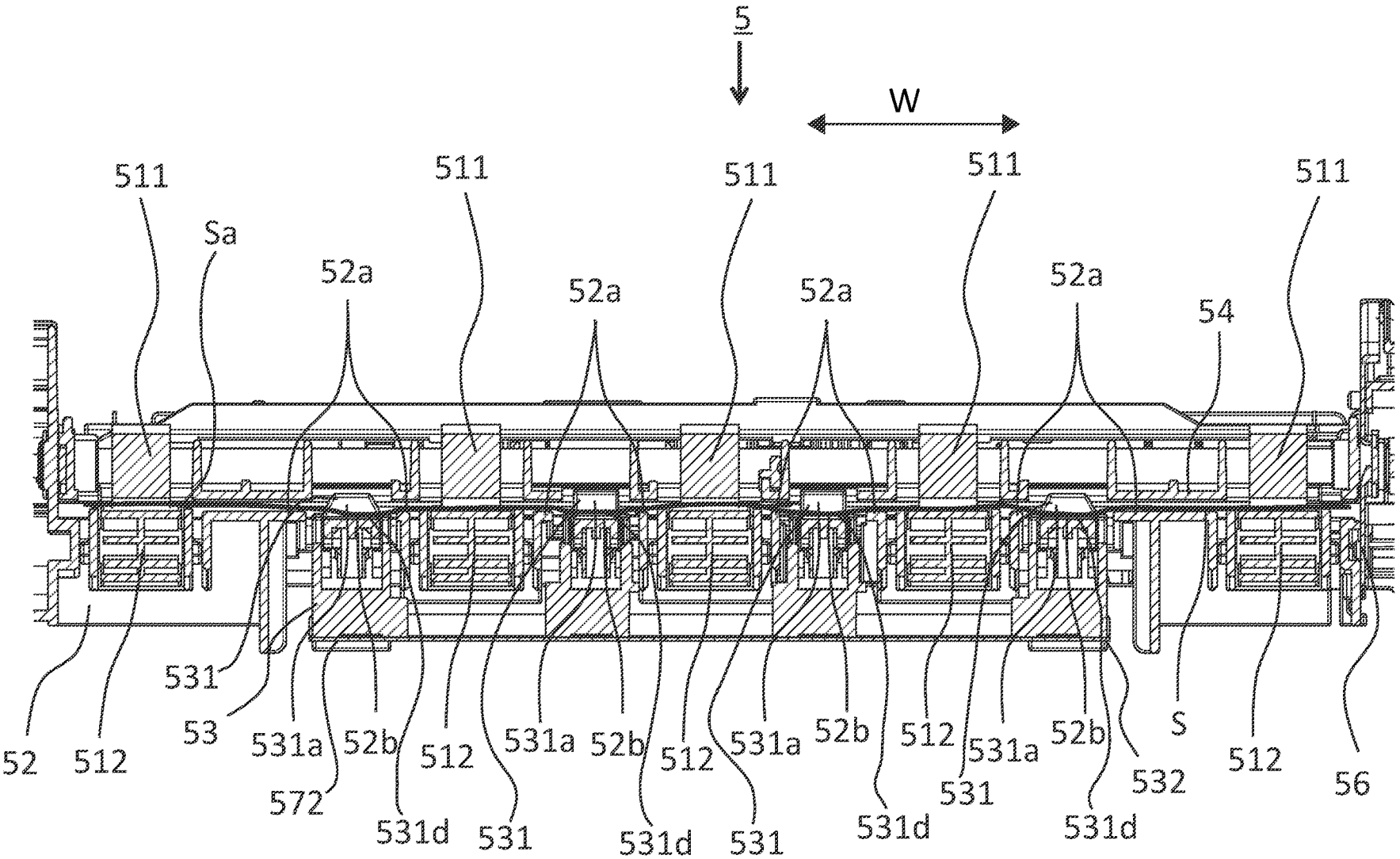
FIG. 5 is a cross-sectional view illustrating a cross section including a leading edge of a sheet when viewed from an upstream in a sheet conveyance direction.

FIG. 5 is a view of a cross section including the leading edge Sa of the sheet S when viewed from upstream in the sheet conveyance direction CD. As illustrated in FIG. 5, at the leading edge Sa of the sheet S, a region abutting on the guide surface 52*a* and a region entering the recess portion 52*b* alternately appear in the width direction W.

For example, when the two sheet contact surfaces 531*a* and 531*a* on the center side in the width direction W are defined as a first abutment portion and a second abutment portion, the skew of the sheet S is corrected by the leading edge Sa abutting against the first abutment portion and the second abutment portion. Then, the leading edge Sa of the sheet S is sandwiched between the guide surface 52*a* disposed between the sheet contact surfaces 531*a* and 531 *a* in the width direction W and the sheet contact surfaces 531*a* and 531*a*, and the leading edge Sa of the sheet S becomes a wavy shape. The leading edge Sa enters the recess portions 52*b* and 52*b* serving as a first recess portion and a second recess portion located at positions overlapping with the sheet contact surfaces 531*a* and 531*a* in the width direction W, respectively.

For example, when one of the two sheet contact surfaces 531*a* and 531*a* on the center side in the width direction W is set as an abutment portion, if the abutment portion is sufficiently long in the width direction W, the skew of the sheet S is corrected only by the abutment portion. The leading edge Sa of the sheet S is sandwiched between the recess portion 52*b* located at a position overlapping with the sheet contact surface 531*a*, which is the abutment portion, in the width direction W and the guide surfaces 52*a* and 52*a*, which are the first guide surface and the second guide surface, disposed on one side and the other side of the recess portion 52*b* or the abutment portion in the width direction W. The leading edge Sa of the sheet S enters the recess portion 52*b* and becomes a wavy shape.

As described above, the leading edge Sa of the sheet S is sandwiched between the guide surface 52*a* displaced in the width direction W and the thickness direction of the sheet and the sheet contact surface 531*a*, so that the leading edge Sa of the sheet S has a wavy shape. As described above, since the sheet contact surface 531*a* of the skew correction member 531 is located on the upstream in the sheet conveyance direction CD as the sheet contact surface is disposed on the outer side of the conveyance path CP1 in the width direction W, the sheet contact surface 531*a* is easily sandwiched between the guide surface 52*a* and the sheet contact surface 531*a* up to the edge of the sheet. Therefore, the entire sheet can be easily waved.

Further, since the sheet S is conveyed by the conveyance unit 4 even while the movement of the sheet S in the sheet conveyance direction CD is restricted by the sheet contact surface 531*a*, a loop is formed upstream of the leading edge Sa in the sheet conveyance direction CD. In the related art, the loop formed on the sheet S abuts on the conveyance guide (for example, the registration frame 52), and the leading edge Sa of the sheet S pushes up the skew correction unit 53 using the reaction force.

However, the size of the loop formed on the sheet S is larger on the side that first abuts on the sheet contact surface 531*a* than on the side that last abuts on the sheet contact surface in the width direction W. Since the size of the loop formed on the sheet S in the width direction W is different, the reaction force received by the sheet S from the conveyance guide is different in the width direction W. For this reason, a phenomenon (hereinafter, referred to as skew returning) in which the skew of the sheet S gradually returns due to a difference in reaction force received in the width direction W after the skew correction unit 53 is pushed up occurs.

Figure 4C:
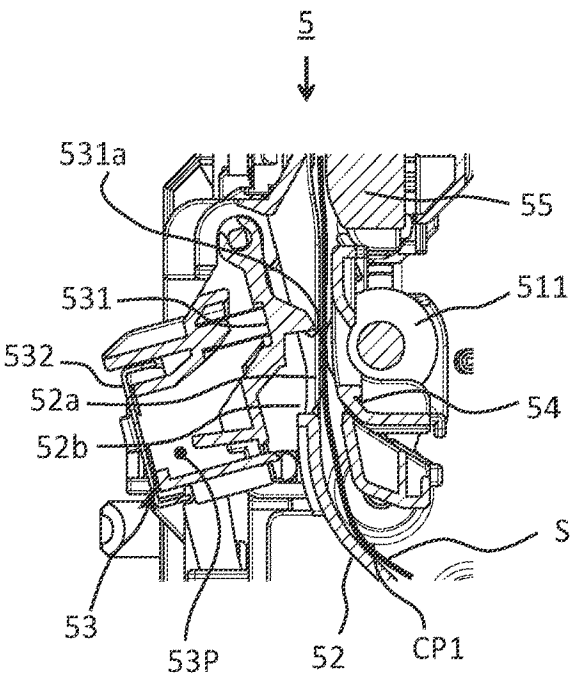
FIG. 4C is a cross-sectional view illustrating a state in which a skew correction unit is pushed up.

However, in the present embodiment, as described above, the cross section secondary moment of the sheet S is increased by waving the leading edge Sa of the sheet S, and the rigidity is temporarily improved. Therefore, even if the leading edge Sa is conveyed by the conveyance unit 4 in a state where the leading edge Sa is dammed by the sheet contact surface 531*a*, it is difficult to form a loop on the sheet S. Therefore, as illustrated in FIG. 4C, the loop of the sheet S does not abut on the registration frame 52, the opposing guide 54, and the like, and the skew correction unit 53 can be pushed up only by the rigidity of the sheet S itself.

When the skew correction unit 53 rotates about the swing shaft 53P from the standby position, the sheet contact surface 531*a* retreats from the conveyance path CP1, and the sheet S can pass through the conveyance path CP1. As a result, the sheet S passes through the registration unit 5 and is conveyed downstream in the sheet conveyance direction CD. While the sheet S is passing through the registration unit 5, the skew correction member 531 is biased by the tension spring 535 and rubs against the surface of the sheet S. When a trailing edge of the sheet S passes through the skew correction member 531, the skew correction member 531 returns to the standby position by the tension spring 535.

As described above, in the present embodiment, by waving the leading edge Sa of the sheet S, the rigidity of the sheet S itself can be temporarily improved, and the loop formed on the sheet S at the time of skew correction can be reduced. As a result, the skew returning can be reduced, and the conveyance failure such as the skew of the sheet can be reduced. In addition, the print image accuracy can be improved, and a good product can be obtained. In particular, for example, a sheet having a small grammage such as thin paper tends to have a large loop formed at the time of the skew correction, but according to the present embodiment, the skew can be satisfactorily corrected regardless of the grammage of the sheet. Furthermore, since the present embodiment has a simple configuration, the skew of the sheet can be corrected with an inexpensive configuration.

Modification

Next, a modification of the first embodiment will be described with reference to FIGS. 6 to 9. Note that configurations similar to those of the first embodiment will be described with illustration omitted or the same reference numerals given to the drawings.

Figure 6:
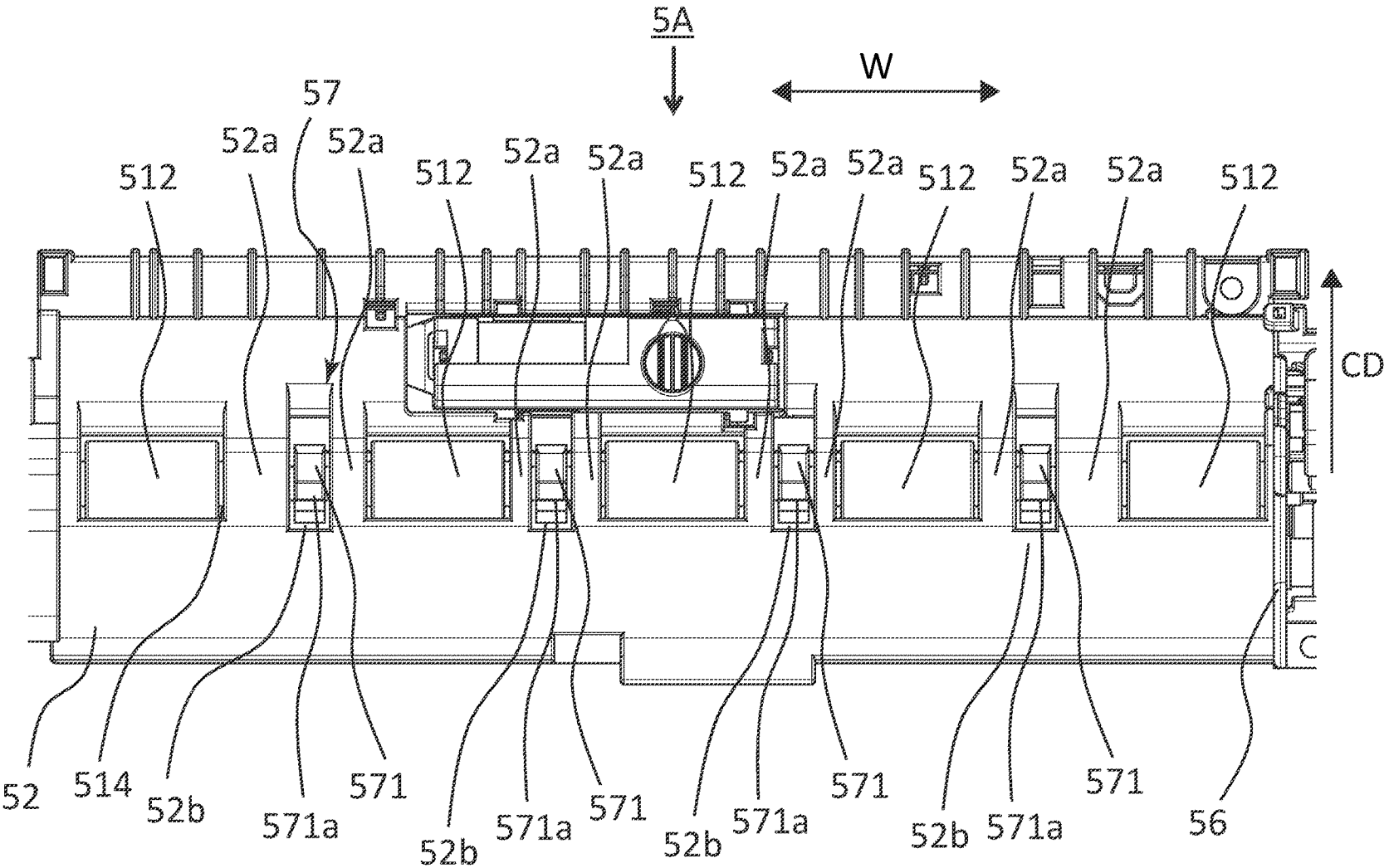
FIG. 6 is a front view illustrating a registration unit according to a modification of the first embodiment.
Figure 7:
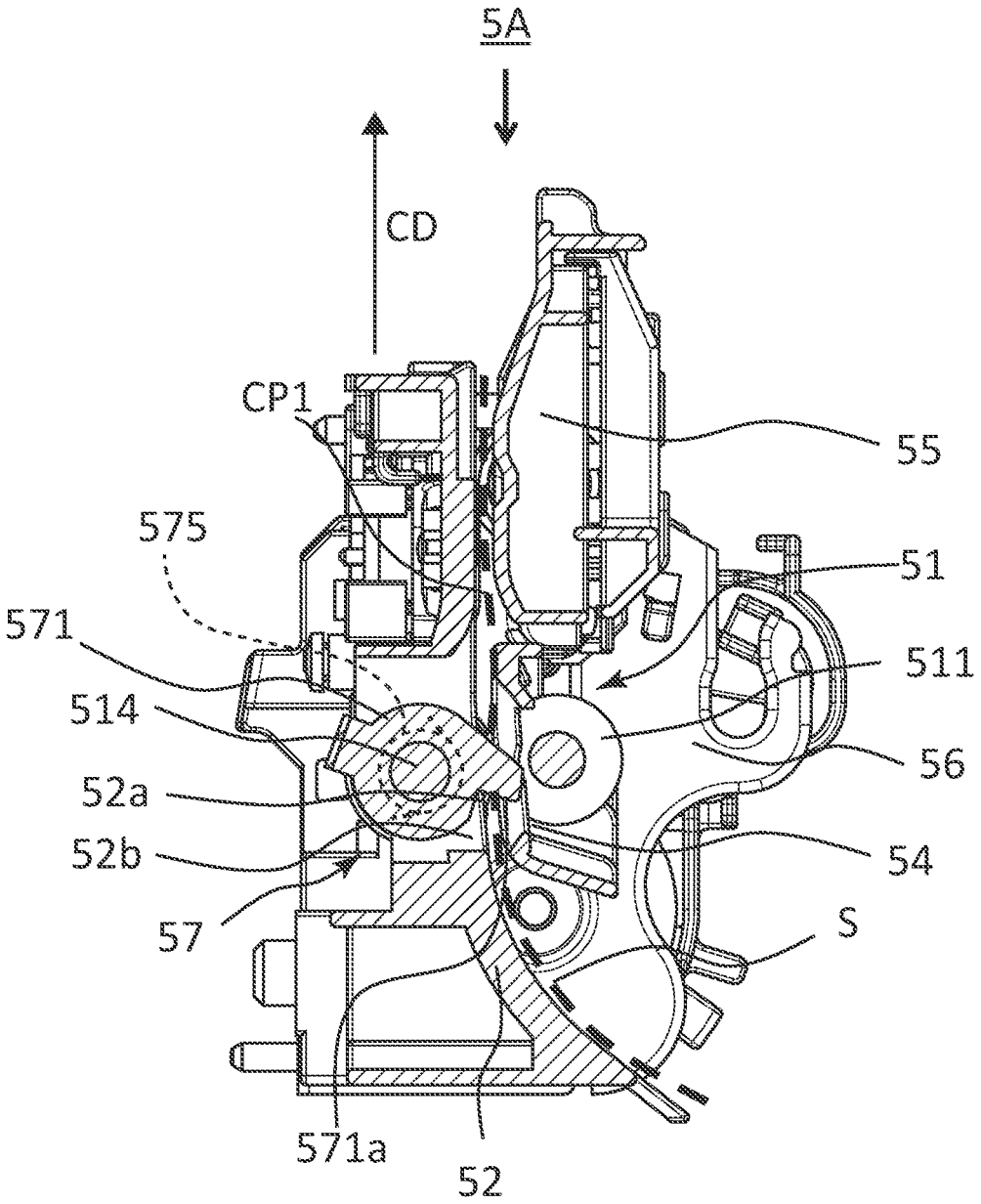
FIG. 7 is a cross-sectional view illustrating a registration unit.

In the first embodiment, the plurality of registration rollers 512 are independently swingably held by the registration holder 513. As illustrated in FIGS. 6 and 7, a registration unit 5A of the present modification includes one registration driven roller shaft 514 supported by the registration frame 52. A plurality of (five in the present modified example) registration rollers 512 are rotatably supported by the registration driven roller shaft 514. The registration driven roller shaft 514 is biased toward the registration roller 511 by a biasing member (not illustrated).

The skew correction unit 57 as the skew correction portion includes a plurality of (four in the present embodiment) skew correction members 571 arranged side by side in the width direction W, and a connecting member 572 connecting the skew correction members 571. The skew correction unit 57 is supported so as to be rotatable about the registration driven roller shaft 514. The skew correction unit 57 is biased to the standby position by a torsion coil spring 575. Note that the skew correction unit 57 may be rotatably supported by the rotation shaft of either one roller, serving as one rotating member, of the registration roller pair 51, and may be rotatably supported by the rotation shaft of the registration driven roller 512.

Figure 8C:
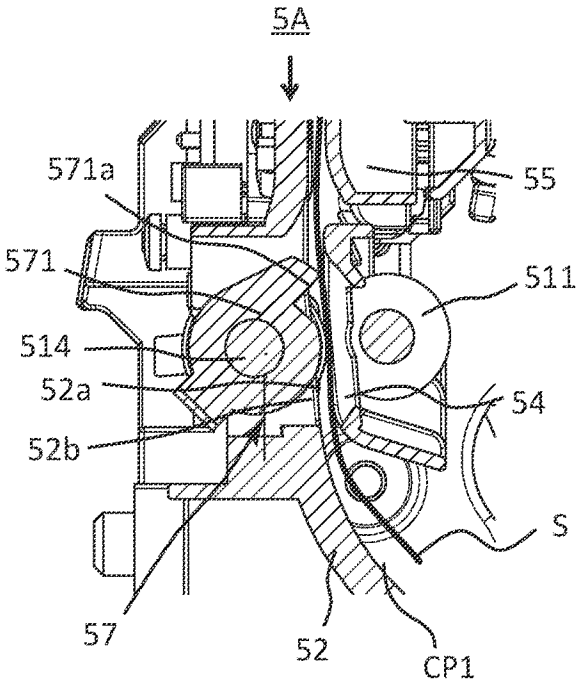
FIG. 8C is a cross-sectional view illustrating a state in which the skew correction unit is pushed up.

The operation of the skew correction unit 57 is similar to that of the skew correction unit 53 of the first embodiment. As illustrated in FIG. 8A, the sheet S conveyed by the conveyance unit 4 enters the registration unit 5A along the conveyance path CP1. Then, the leading edge Sa of the sheet S abuts on any sheet contact surface 571*a* of the plurality of skew correction members 571 located at the standby position.

At this time, when the sheet S is conveyed in a skewed state, the leading edge of the sheet S on the leading side in the width direction W first comes into contact with the sheet contact surface 571*a*. Then, the sheet S turns about the contact portion with the sheet contact surface 571*a* that abuts first, and also abuts on the sheet contact surface 571*a* of the other skew correction member 571.

Figure 8B:
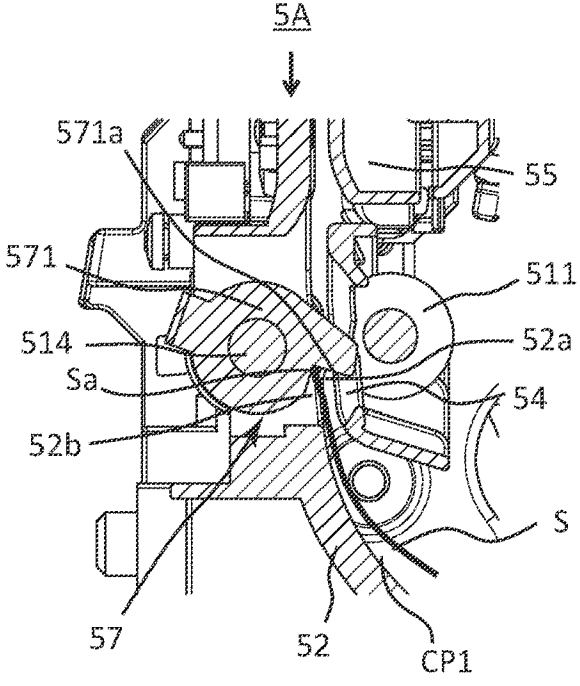
FIG. 8B is a cross-sectional view illustrating a state in which the leading edge of the sheet moves to a root portion of the sheet contact surface.
Figure 8A:
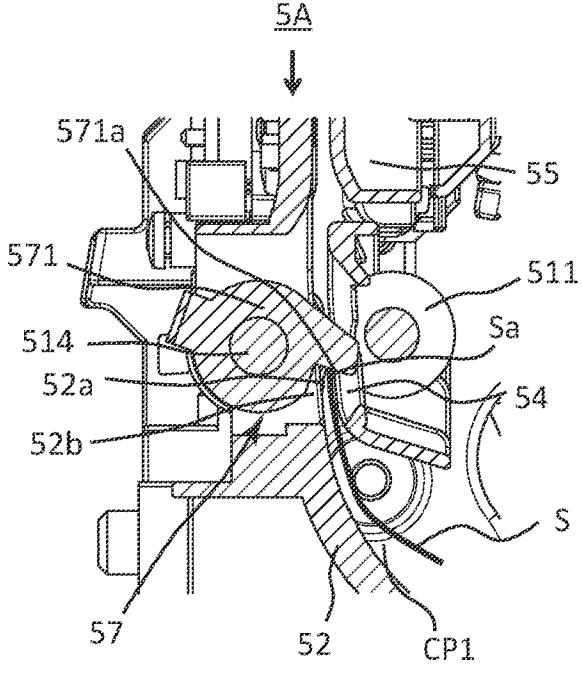
FIG. 8A is a cross-sectional view illustrating a state in which a leading edge of a sheet abuts a sheet contact surface.

As illustrated in FIG. 8B, the sheet contact surface 571*a* as the abutment portion, the first abutment portion, and the second abutment portion is inclined toward the downstream in the sheet conveyance direction CD as the sheet contact surface goes from the leading edge toward the root portion. Therefore, the leading edge Sa, abutting on the sheet contact surface 571*a*, of the sheet S is guided toward the root portion. Therefore, the leading edge Sa of the sheet S moves toward the root portion of the sheet contact surface 571*a* while turning. The skew of the sheet S is corrected by the leading edge Sa of the sheet S abutting on at least two sheet contact surfaces 571*a* among the sheet contact surfaces 571*a* of the plurality of (four) skew correction members 571.

As described above, the recess portion 52*b* is formed at a position overlapping with the skew correction member 571 of the registration frame 52 in the width direction W. Therefore, the leading edge Sa of the sheet S whose skew has been corrected has a region abutting on the guide surface 52*a* and a region entering the recess portion 52*b*, and these regions are different in position from each other in the thickness direction of the sheet.

Figure 9:
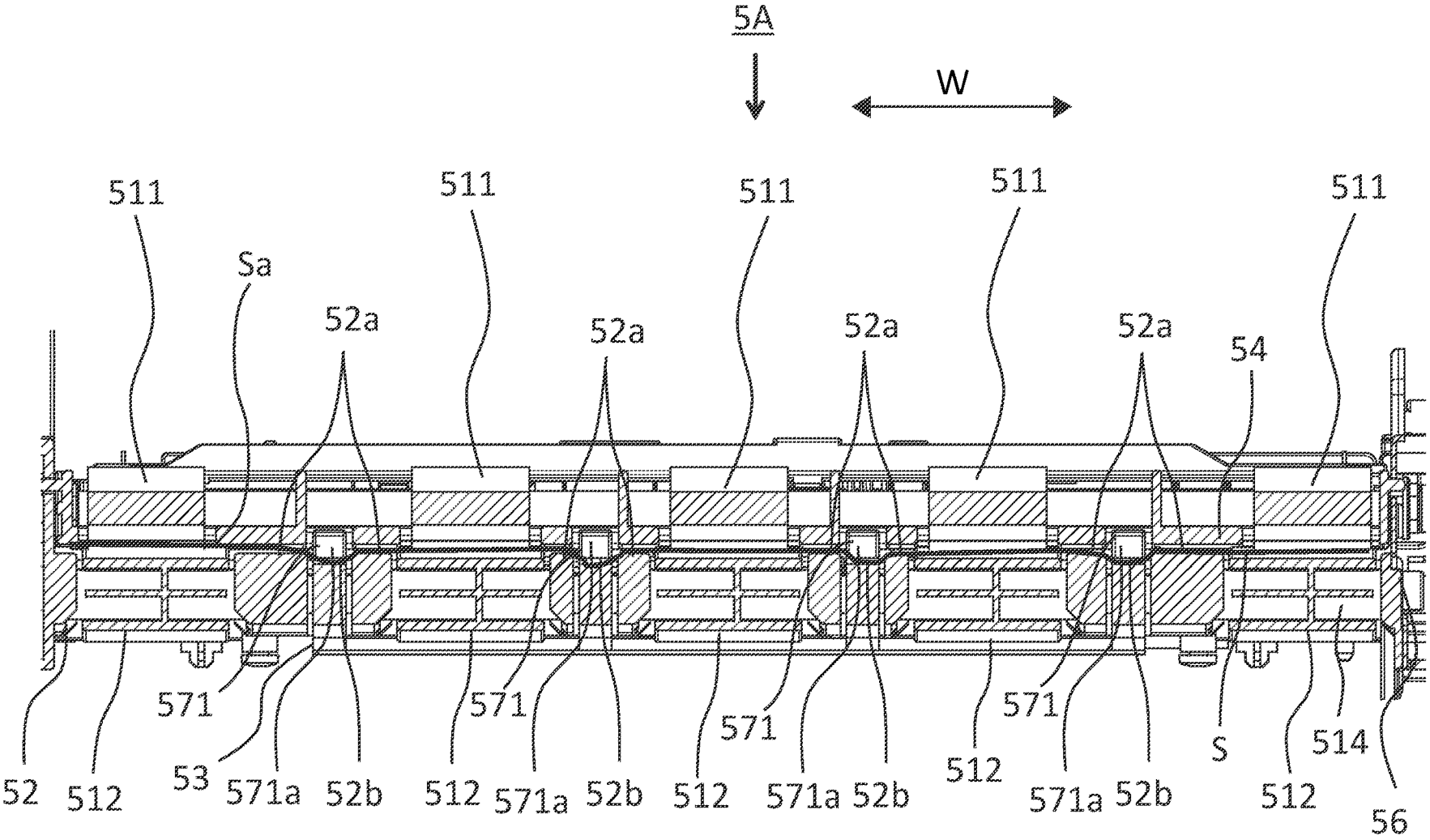
FIG. 9 is a cross-sectional view illustrating a cross section including a leading edge of a sheet when viewed from upstream in a sheet conveyance direction.

FIG. 9 is a view of a cross section including the leading edge Sa of the sheet S when viewed from upstream in the sheet conveyance direction CD. As illustrated in FIG. 9, at the leading edge Sa of the sheet S, a region abutting on the guide surface 52*a* and a region entering the recess portion 52*b* alternately appear in the width direction W. As described above, the leading edge Sa of the sheet S is sandwiched between the guide surface 52*a* displaced in the width direction W and the thickness direction of the sheet and the sheet contact surface 571*a*, so that the leading edge Sa of the sheet S has a wavy shape.

By waving the leading edge Sa of the sheet S, the cross section secondary moment of the sheet S is increased, and the rigidity is temporarily improved. Therefore, even if the leading edge Sa is conveyed by the conveyance unit 4 in a state where the leading edge Sa is dammed by the sheet contact surface 571*a*, it is difficult to form a loop on the sheet S. Therefore, as illustrated in FIG. 8C, the loop of the sheet S does not abut on the registration frame 52, the opposing guide 54, and the like, and the skew correction unit 57 can be pushed up only by the rigidity of the sheet S itself.

When the skew correction unit 57 rotates about the registration driven roller shaft 514 from the standby position, the sheet contact surface 571*a* retreats from the conveyance path CP1, and the sheet S can pass through the conveyance path CP1. As a result, the sheet S passes through the registration unit 5A and is conveyed downstream in the sheet conveyance direction CD. While the sheet S is passing through the registration unit 5A, the skew correction member 571 is biased by the torsion coil spring 575 and rubs against the surface of the sheet S. When the trailing edge of the sheet S passes through the skew correction member 571, the skew correction member 571 returns to the standby position by the torsion coil spring 575.

As described above, in the present embodiment, by waving the leading edge Sa of the sheet S, the rigidity of the sheet S itself can be temporarily improved, and the loop formed on the sheet S at the time of skew correction can be reduced. As a result, the skew returning can be reduced, and the conveyance failure such as the skew of the sheet can be reduced. In addition, the print image accuracy can be improved, and a good product can be obtained. In particular, for example, a sheet having a small grammage such as thin paper tends to have a large loop formed at the time of the skew correction, but according to the present embodiment, the skew can be satisfactorily corrected regardless of the grammage of the sheet. Furthermore, since the present embodiment has a simple configuration, the skew of the sheet can be corrected with an inexpensive configuration.

Second Embodiment

Next, a second embodiment of the present invention will be described, but the second embodiment is different from the first embodiment in the pressurization configuration of the registration driven roller and the configuration of the skew correction unit. Therefore, a configuration similar to that of the first embodiment will be described by omitting illustration or attaching the same reference numerals to the drawings.

Registration Unit

Figure 10:
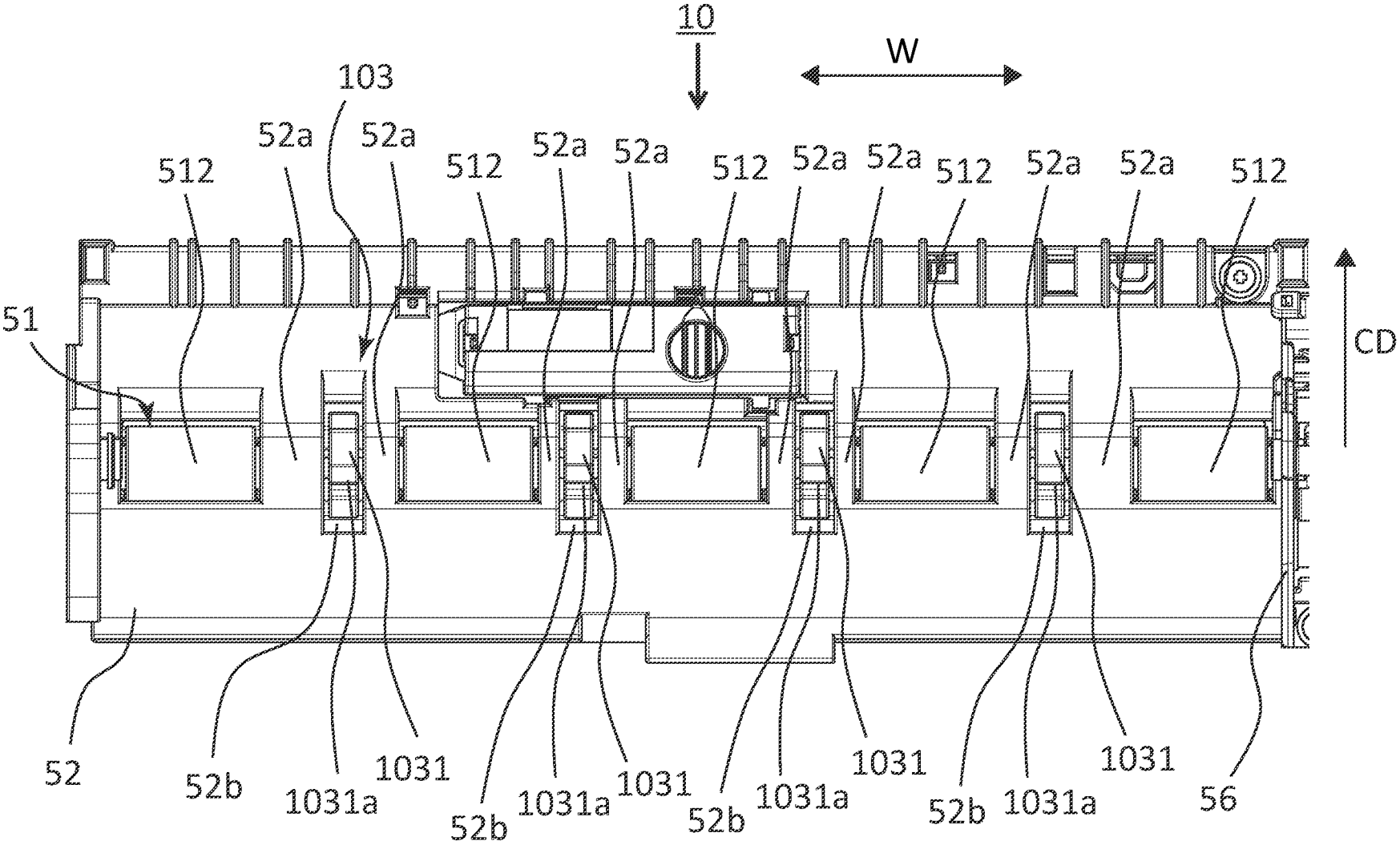
FIG. 10 is a front view illustrating a registration unit according to a second embodiment.
Figure 11:
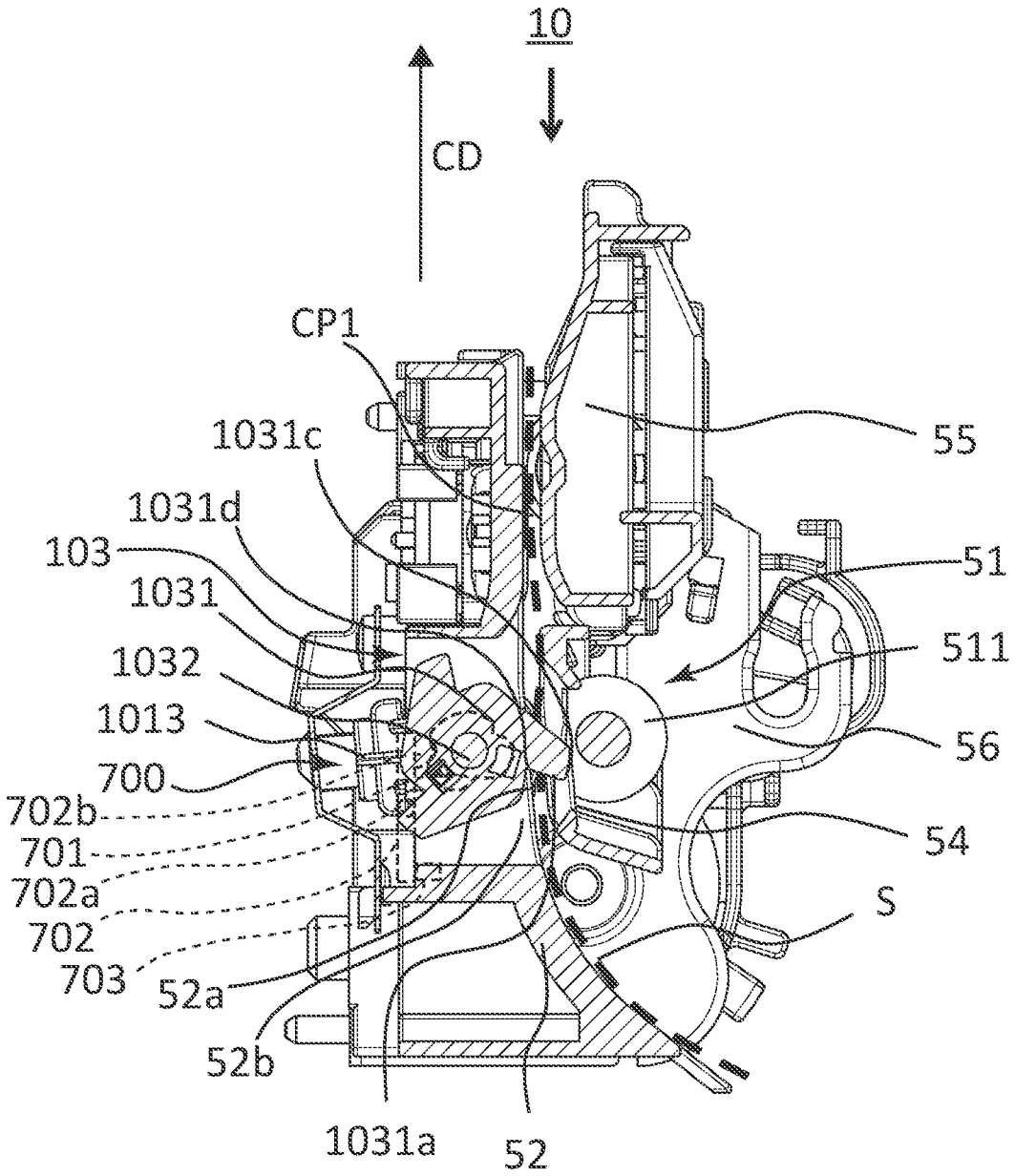
FIG. 11 is a cross-sectional view illustrating a registration unit.

As illustrated in FIGS. 10 and 11, the registration unit 10 according to the present embodiment includes a plurality of registration roller pairs 51 and a skew correction unit 103. The five registration roller pairs 51 are arranged side by side in the width direction W orthogonal to the sheet conveyance direction CD. The registration roller pair 51 includes a registration roller 511 and a registration driven roller 512. The registration roller 511 and the registration driven roller 512 form a conveyance nip N1 (see FIG. 1) for conveying the sheet S.

A registration holder 1013 is supported as linearly movable by the registration frame 52, and the registration holder 1013 rotatably supports a plurality of (five in the present embodiment) registration rollers 512. The registration driven roller 512 is pressed against the registration roller 511 by a spring (not illustrated) that biases the registration holder 1013.

Skew Correction Unit

Next, the skew correction unit 103 will be described with reference to FIGS. 10 to 13. As illustrated in FIGS. 10 and 11, the skew correction unit 103 as a skew correction portion includes a plurality of skew correction members 1031 and a shaft member 1032 that connects the skew correction members 1031. In the present embodiment, four skew correction members 1031 are arranged side by side in the width direction W, and each skew correction member 1031 is disposed so as to be sandwiched between two registration roller pairs 51 in the width direction W. That is, the registration roller pair 51 and the skew correction member 1031 are alternately arranged in the width direction W.

In addition, the registration frame 52 has a plurality of guide surfaces 52*a* provided with gaps therebetween in the width direction W, and the skew correction member 1031 and the registration driven roller 512 are arranged in the gaps between the guide surfaces 52*a*. Therefore, the guide surface 52*a* is disposed between the skew correction member 1031 and the registration driven roller 512.

The skew correction unit 103 is rotatably supported with respect to the registration frame 52 about the shaft member 1032, and is positioned at the standby position illustrated in FIG. 11 by a positioning unit 700. Note that, since the skew correction unit 103 of the present embodiment is formed symmetrically about the shaft member 1032, every time the skew correction unit rotates by 120 degrees, the skew correction unit takes a similar posture, that is, a standby position. Hereinafter, a position (second standby position) rotated by 120 degrees from the standby position (first standby position) and a position (third standby position) further rotated by 120 degrees are also referred to as the standby position in the skew correction unit 103. The position of the skew correction member 1031 when the skew correction unit 103 is located at the standby position is also referred to as the standby position. The positioning unit 700 includes a cam 701, a lever 702, and a compression spring 703. The cam 701 is fixed to the shaft member 1032 and rotates integrally with the plurality of skew correction members 1031. The cam 701 is provided with three recess portions. The lever 702 is supported by the registration frame 52 so as to be rotatable about the rotation shaft 702*a*, and an engagement portion 702*b* engageable with the recess portion of the cam 701 is provided at one end. The compression spring 703 is compressed between the other end of the lever 702 and the registration frame 52, and biases the lever 702 such that the engagement portion 702*b* engages with the recess portion of the cam 701. The skew correction unit 103 and the skew correction member 1031 are located at the standby positions when the engagement portion 702*b* is engaged with one of the three recess portions of the cam 701. The skew correction member 1031 includes a main body portion 1031*b* and three sheet contact surfaces 1031*a* that extend from the main body portion 1031*b* and can be brought into contact with the leading edge of the sheet S passing through the conveyance path CP1.

The sheet contact surface 1031*a* protrudes to the conveyance path CP1 when the skew correction member 1031 is located at the contact position, and is disposed upstream of the conveyance nip N1 of the registration roller pair 51 in the sheet conveyance direction CD. At this time, the sheet contact surface 1031*a* as the abutment portion, the first abutment portion, and the second abutment portion is inclined upstream in the sheet conveyance direction CD toward the leading edge of the sheet contact surface, that is, away from the main body portion 1031*b* when viewed in the width direction W. When viewed in the width direction W, a leading edge 1031*c* of the sheet contact surface 1031*a* is located inside of the opposing guide 54, and the root portion 531*d* of the sheet contact surface 1031*a* is located inside of the registration frame 52 with respect to the guide surface 52*a*.

As described above, the recess portion 52*b* is formed at a position overlapping with the skew correction member 1031 of the registration frame 52 in the width direction W. The recess portion 52*b* at least extends upstream from a position overlapping with the root portion 1031*d* of the sheet contact surface 1031*a* in the sheet conveyance direction CD, but may also extend downstream from a position overlapping with the root portion 531*d*. Note that the recess portion 52*b* may have any configuration such as a hole, an opening, and a groove as long as the recess portion is formed such that the space communicates with the inside of the registration frame 52 more than the guide surface 52*a* when viewed in the width direction W.

In addition, among the sheet contact surfaces 1031*a* of the plurality of skew correction members 1031, the sheet contact surface arranged on an outer side of the conveyance path CP1 in the width direction W is located closer to upstream in the sheet conveyance direction CD than the sheet contact surface arranged u inner side of the conveyance path CP1. In the present embodiment, since the four skew correction members 1031 are provided, the two sheet contact surfaces 1031*a* arranged on the outer side in the width direction W are located upstream of the two sheet contact surfaces 1031*a* arranged on the inner side in the sheet conveyance direction CD.

Figure 12A:
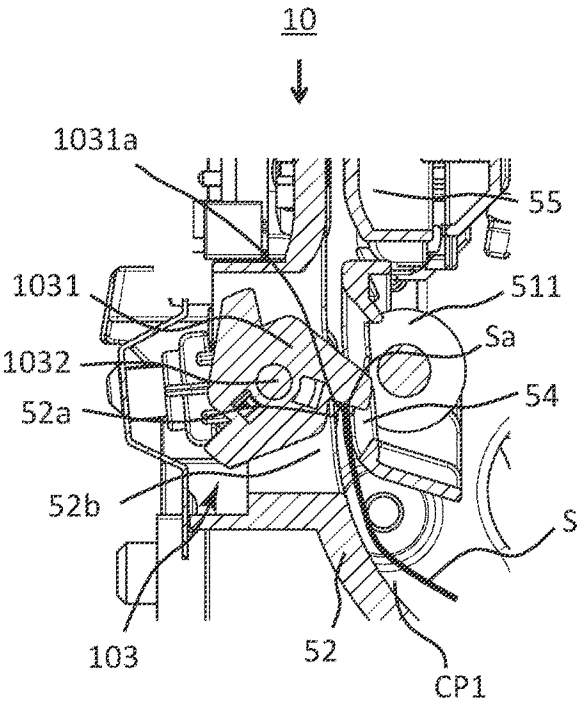
FIG. 12A is a cross-sectional view illustrating a state in which a leading edge of a sheet abuts a sheet contact surface.

Next, the operation of the skew correction unit 103 will be described with reference to FIGS. 12A to 13. As illustrated in FIG. 12A, the sheet S conveyed by the conveyance unit 4 enters the registration unit 10 along the conveyance path CP1. Then, the leading edge Sa of the sheet S abuts on any sheet contact surface 1031*a* of the plurality of skew correction members 1031 located at the standby position.

At this time, when the sheet S is conveyed in a skewed state, the leading edge of the sheet S on the leading side in the width direction W first comes into contact with the sheet contact surface 1031*a*. Then, the sheet S turns about the contact portion with the sheet contact surface 1031*a* that abuts first, and also abuts on the sheet contact surface 1031*a* of the other skew correction member 1031.

Figure 12B:
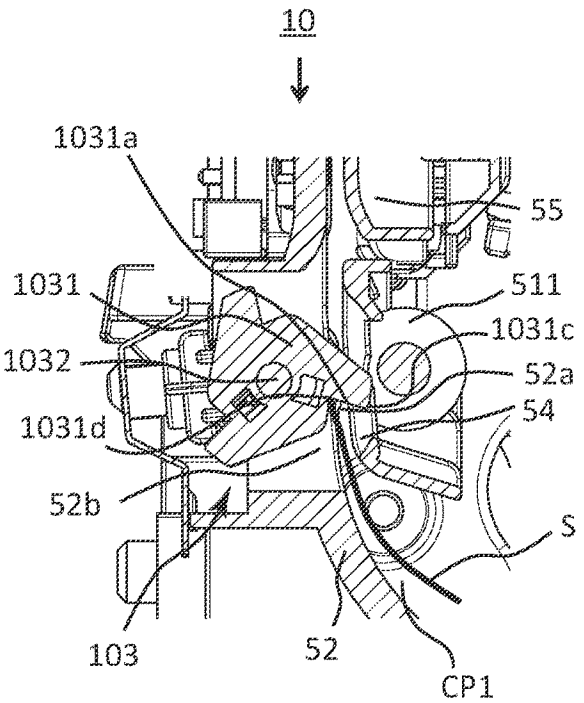
FIG. 12B is a cross-sectional view illustrating a state in which the leading edge of the sheet moves to a root portion of the sheet contact surface.

As illustrated in FIG. 12B, the sheet contact surface 1031*a* is inclined toward downstream in the sheet conveyance direction CD from the leading edge 1031*c* toward the root portion 531*d*. Therefore, the leading edge Sa, abutting on the sheet contact surface 1031*a*, of the sheet S is guided toward the root portion 1031*d*. Therefore, the leading edge Sa of the sheet S moves toward the root portion 1031*d* while turning. The skew of the sheet S is corrected by the leading edge Sa of the sheet S abutting on at least two sheet contact surfaces 1031*a* among the sheet contact surfaces 1031*a* of the plurality of (four) skew correction members 1031. At the time when the skew of the sheet S is corrected, the biasing force of the compression spring 703 as the biasing portion for holding the skew correction unit 103 at the standby position is larger than the pressing force with which the sheet S presses the sheet contact surface 1031*a*.

As described above, the recess portion 52*b* is formed at a position overlapping with the skew correction member 1031 of the registration frame 52 in the width direction W. Therefore, the leading edge Sa of the sheet S whose skew has been corrected has a region abutting on the guide surface 52*a* and a region entering the recess portion 52*b*, and these regions are different in position from each other in the thickness direction of the sheet.

Figure 13:
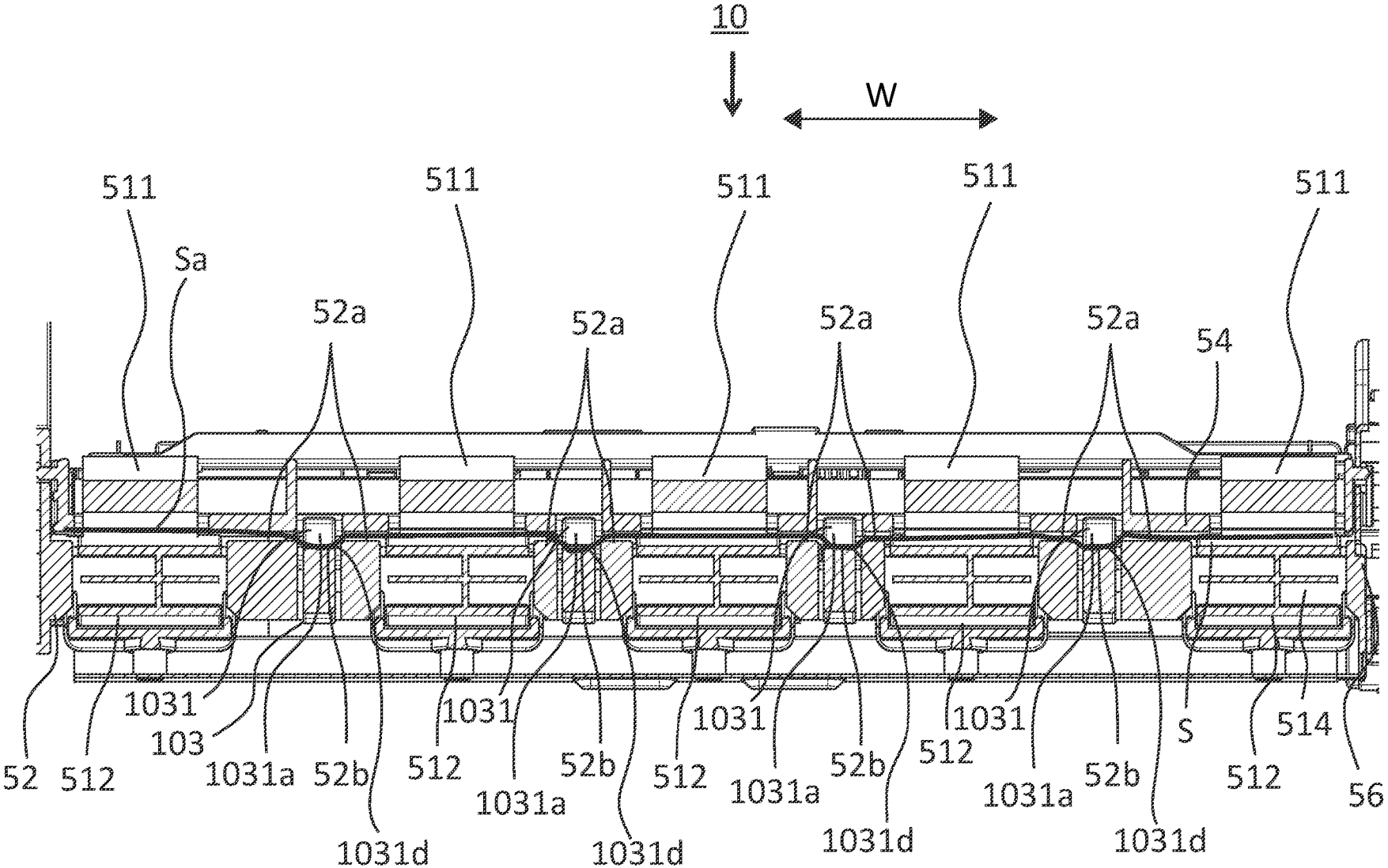
FIG. 13 is a cross-sectional view illustrating a cross section including a leading edge of a sheet when viewed from the upstream in the sheet conveyance direction.

FIG. 13 is a view of a cross section including the leading edge Sa of the sheet S when viewed from upstream in the sheet conveyance direction CD. As illustrated in FIG. 13, at the leading edge Sa of the sheet S, a region abutting on the guide surface 52*a* and a region entering the recess portion 52*b* alternately appear in the width direction W. As described above, the leading edge Sa of the sheet S is sandwiched between the guide surface 52*a* displaced in the width direction W and the thickness direction of the sheet and the sheet contact surface 1031*a*, so that the leading edge Sa of the sheet S has a wavy shape. As described above, since the sheet contact surface 1031*a* of the skew correction member 1031 is located upstream in the sheet conveyance direction CD as the sheet contact surface is disposed on the outer side of the conveyance path CP1 in the width direction W, the sheet contact surface 1031*a* is easily sandwiched between the guide surface 52*a* and the sheet contact surface 1031*a* up to the edge of the sheet. Therefore, the entire sheet can be easily waved.

Figure 12C:
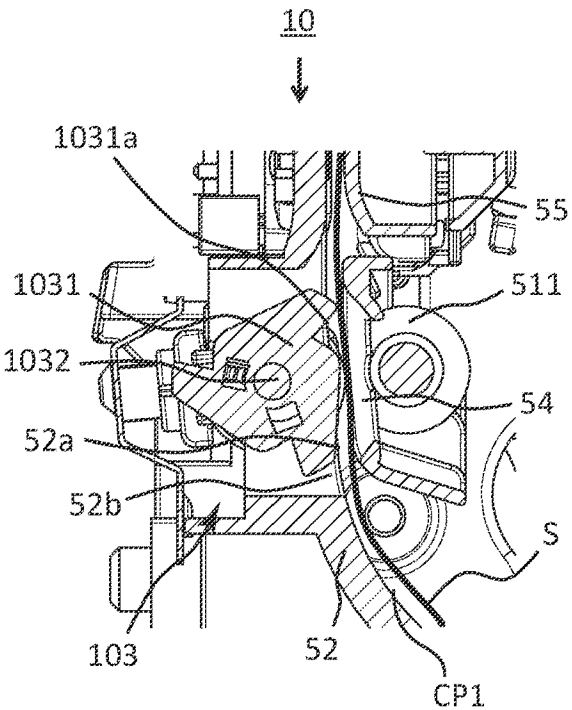
FIG. 12C is a cross-sectional view illustrating a state in which the skew correction unit is pushed up.

Further, since the sheet S is conveyed by the conveyance unit 4 even while the movement of the sheet S in the sheet conveyance direction CD is restricted by the sheet contact surface 1031*a*, a loop is formed upstream of the leading edge Sa in the sheet conveyance direction CD. However, by waving the leading edge Sa of the sheet S, the cross section secondary moment of the sheet S is increased, and the rigidity is temporarily improved. Therefore, even if the leading edge Sa is conveyed by the conveyance unit 4 in a state where the leading edge Sa is dammed by the sheet contact surface 1031*a*, it is difficult to form a loop on the sheet S. Therefore, as illustrated in FIG. 12C, the loop of the sheet S does not abut on the registration frame 52, the opposing guide 54, and the like, and the skew correction unit 103 can be pushed up only by the rigidity of the sheet S itself.

When the skew correction unit 103 rotates about the shaft member 1032 from the standby position, the sheet contact surface 1031*a* retreats from the conveyance path CP1, and the sheet S can pass through the conveyance path CP1. As a result, the sheet S passes through the registration unit 10 and is conveyed downstream in the sheet conveyance direction CD. While the sheet S is passing through the registration unit 10, the skew correction member 1031 rubs against the surface of the sheet S by the biasing force of the compression spring 703. When the trailing edge of the sheet S passes through the skew correction member 1031, the skew correction member 1031 shifts to the next standby position.

As described above, in the present embodiment, by waving the leading edge Sa of the sheet S, the rigidity of the sheet S itself can be temporarily improved, and the loop formed on the sheet S at the time of skew correction can be reduced. As a result, the skew returning can be reduced, and the conveyance failure such as the skew of the sheet can be reduced. In addition, the print image accuracy can be improved, and a good product can be obtained. In particular, for example, a sheet having a small grammage such as thin paper tends to have a large loop formed at the time of the skew correction, but according to the present embodiment, the skew can be satisfactorily corrected regardless of the grammage of the sheet.

Furthermore, since the present embodiment has a simple configuration, the skew of the sheet can be corrected with an inexpensive configuration. Further, the skew correction unit 103 rotates only in one direction by being pressed by the leading edge Sa of the sheet S. Therefore, when the trailing edge of the sheet S passes through the first sheet contact surface 1031*a*, the second sheet contact surface 1031*a* immediately protrudes to the conveyance path CP1, and the skew correction of the succeeding sheet can be prepared. Therefore, it is possible to reduce the interval between sheets conveyed continuously, that is, the sheet interval, and to improve the throughput.

Third Embodiment

Next, a third embodiment of the present invention will be described, but the third embodiment is different from the first embodiment in the pressurizing configuration of the registration roller and the configuration of the skew correction unit. Therefore, a configuration similar to that of the first embodiment will be described by omitting illustration or attaching the same reference numerals to the drawings.

Registration Unit

Figure 14:
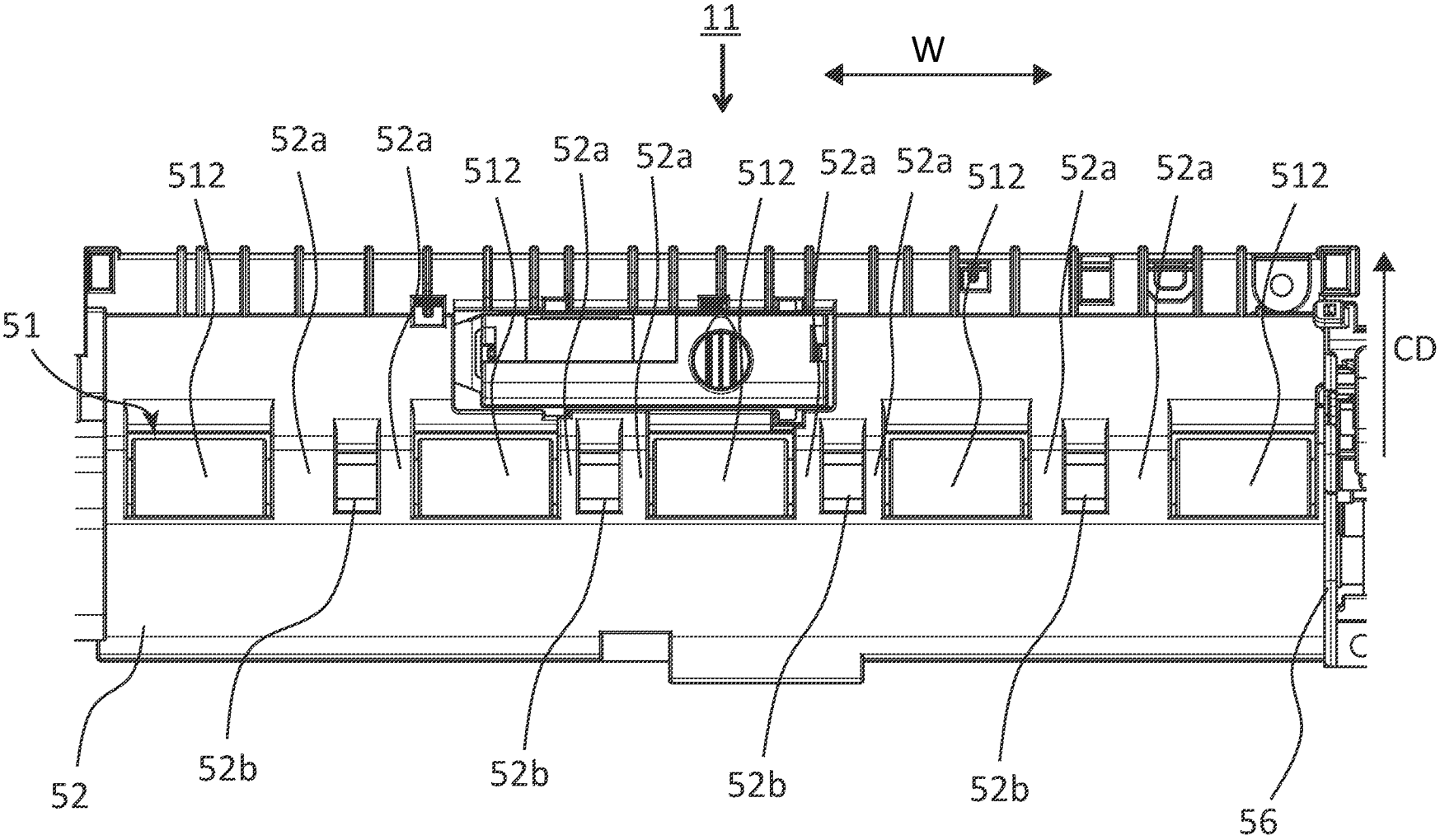
FIG. 14 is a front view illustrating a registration unit according to a third embodiment.
Figure 15:
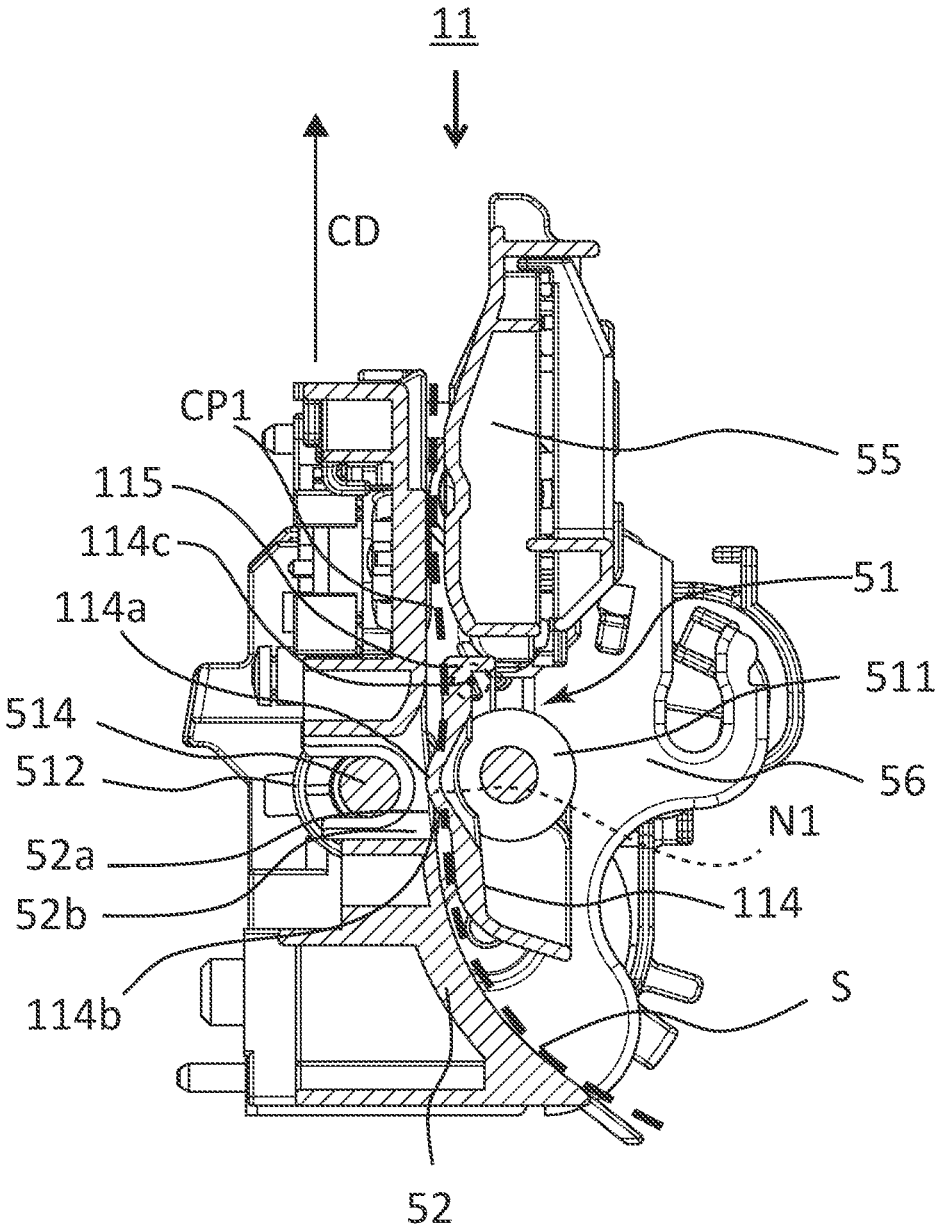
FIG. 15 is a cross-sectional view illustrating a registration unit.

As illustrated in FIGS. 14 and 15, the registration unit 11 as the skew correction portion according to the present embodiment includes a plurality of registration roller pairs 51 as a first rotating member pair and a second rotating member pair, and a swing guide 114. The five registration roller pairs 51 are arranged side by side in the width direction W orthogonal to the sheet conveyance direction CD. The registration roller pair 51 includes a registration roller 511 and a registration driven roller 512. The registration roller 511 and the registration driven roller 512 form a conveyance nip N1 as a first nip and a second nip for conveying the sheet S.

One registration driven roller shaft 514 is supported by the registration frame 52, and a plurality of (five in the present modification) registration rollers 512 are rotatably supported by the registration driven roller shaft 514. The registration driven roller shaft 514 is biased toward the registration roller 511 by a biasing member (not illustrated).

In the present embodiment, the skew correction member against which the leading edge Sa of the sheet S abuts is not provided, and the skew of the sheet S is corrected by the leading edge Sa abutting the conveyance nip N1. That is, in the present embodiment, a stop roller system is adopted. The drive control of the registration roller 511 is performed by the control unit 95 (see FIG. 1).

The registration frame 52 is provided with gaps therebetween in the width direction W, and includes a plurality of guide surfaces 52*a* forming the conveyance path CP1. The recess portion 52*b* and the registration driven roller 512 similar to those in the first and second embodiments are arranged in these gaps. Therefore, the guide surface 52*a* is disposed between the recess portion 52*b* and the registration driven roller 512, and the recess portion 52*b* is disposed between the two adjacent registration rollers 512.

On the registration frame 52, a swing guide 114 is swingably supported about a swing shaft 114*c* extending in the width direction W, and the swing guide 114 is positioned at the standby position illustrated in FIG. 15 by the torsion coil spring 115. The swing guide 114 has a plurality of (four in the present embodiment) protrusion portions 114*a* that enter the plurality of recess portions 52*b*, respectively, in a state of being located at the standby position. The protrusion portion 114*a* has an inclined surface 114*b* disposed upstream of the conveyance nip N1 in the sheet conveyance direction CD. The inclined surface 114*b* is inclined toward the recess portion 52*b* as the inclined surface 114*b* extends downstream in the sheet conveyance direction CD when viewed in the width direction W.

In the present embodiment, the four protrusion portions 114*a* are formed in one swing guide 114, and the four protrusion portions 114*a* swing integrally, but the present invention is not limited thereto. For example, a plurality of swing guides that swing separately may be provided, and each swing guide may be provided with a protrusion portion.

Figure 16A:
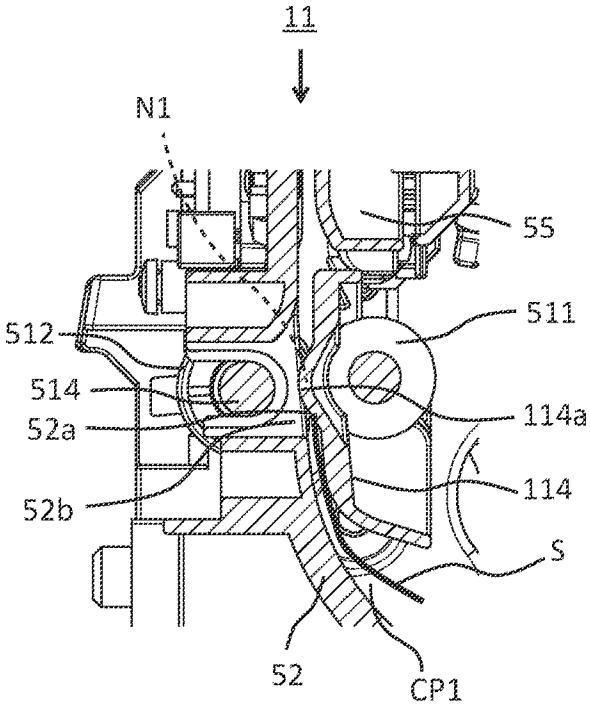
FIG. 16A is a cross-sectional view illustrating a state in which a leading edge of a sheet abuts a conveyance nip.

As illustrated in FIG. 16A, the sheet S conveyed by the conveyance unit 4 enters the registration unit 11 along the conveyance path CP1. Then, the leading edge Sa of the sheet S abuts on the conveyance nip N1 of the registration roller pair 51 in the stopped state.

At this time, when the sheet S is conveyed in a skewed state, the leading edge of the sheet S on the leading side in the width direction W first comes into contact with the conveyance nip N1. Then, the sheet S turns about the contact portion with the conveyance nip N1 that abuts first so that the leading edge Sa follows the conveyance nip N1.

Figure 16B:
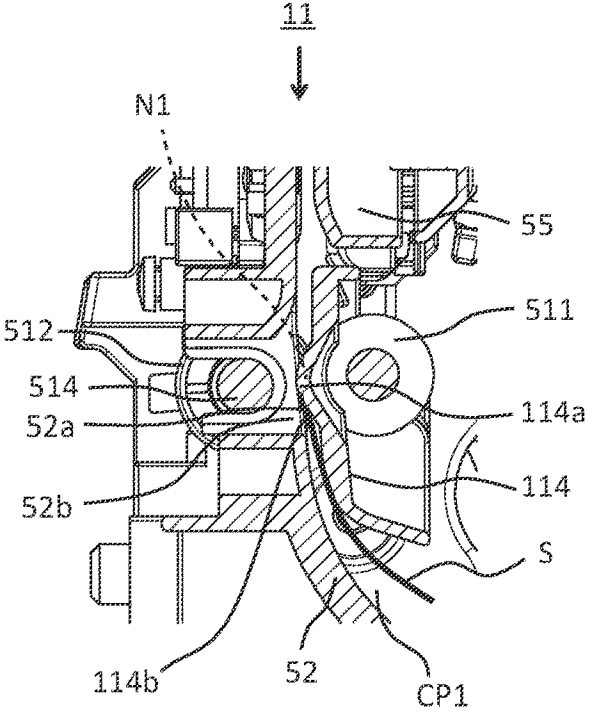
FIG. 16B is a cross-sectional view illustrating a state in which the leading edge of the sheet is pushed into a recess portion by a protrusion portion.

As illustrated in FIG. 16B, the inclined surface 114*b* of the protrusion portion 114*a* of the swing guide 114 is inclined toward the recess portion 52*b* in the thickness direction of the sheet as the inclined surface 114*b* extends downstream in the sheet conveyance direction CD. Therefore, the leading edge Sa, abutting on the conveyance nip N1, of the sheet S is guided toward the recess portion 52*b* by being pressed by the protrusion portion 114*a*.

Therefore, the leading edge Sa of the sheet S whose skew has been corrected by following the conveyance nip N1 has a region abutting on the guide surface 52*a* and a region entering the recess portion 52*b*, and these regions have positions different from each other in the thickness direction of the sheet.

Figure 17:
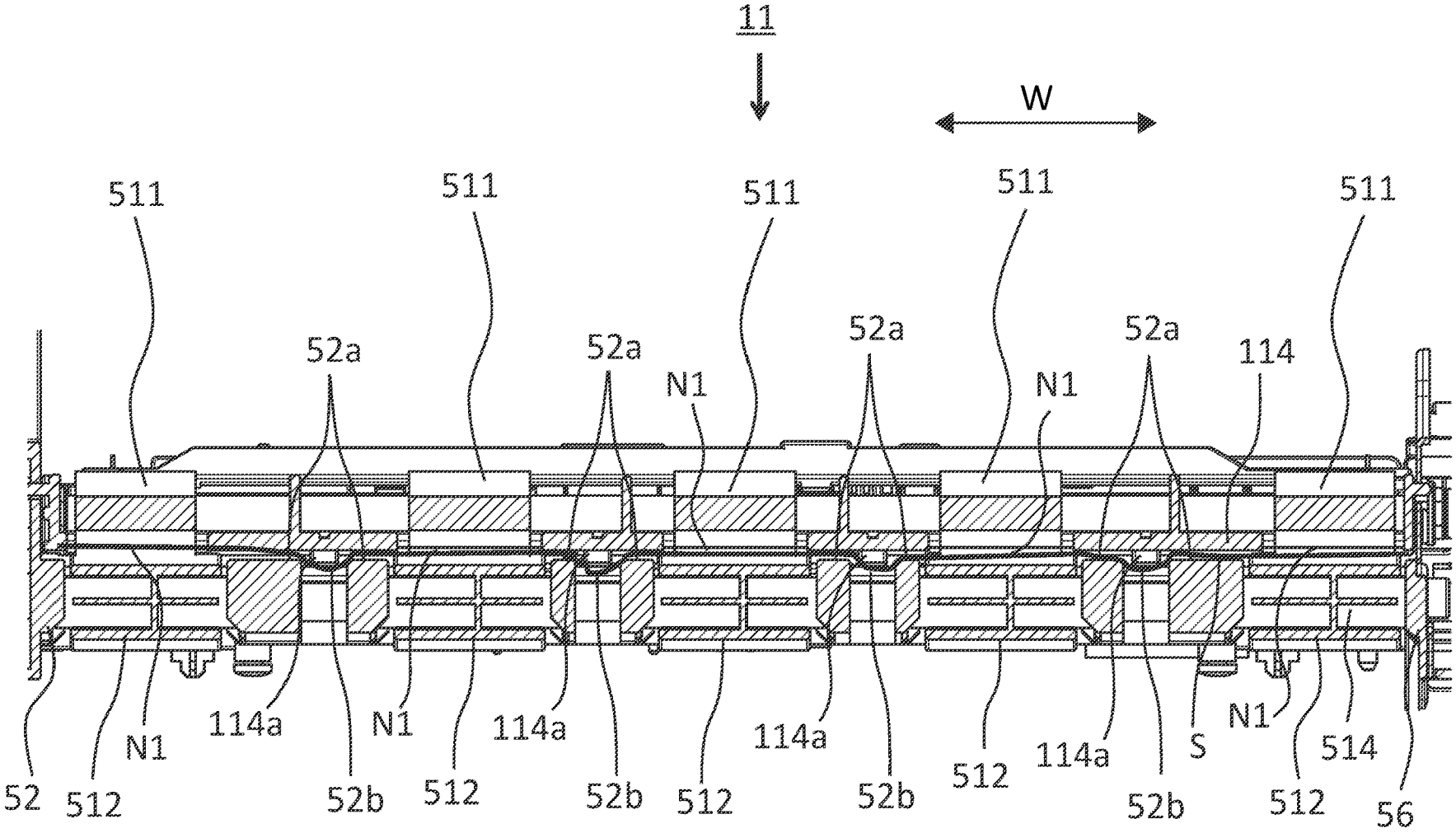
FIG. 17 is a cross-sectional view illustrating a cross section including a leading edge of a sheet when viewed from the upstream in the sheet conveyance direction.

FIG. 17 is a view of a cross section including the leading edge Sa of the sheet S when viewed from the upstream in the sheet conveyance direction CD. As illustrated in FIG. 17, at the leading edge Sa of the sheet S, a region abutting on the guide surface 52*a* and a region entering the recess portion 52*b* alternately appear in the width direction W.

For example, when any two conveyance nips N1 and N1 on the center side in the width direction W are the first nip and the second nip, the leading edge Sa abuts against the first nip and the second nip, so that the skew of the sheet S is corrected. Then, the leading edge Sa of the sheet S is sandwiched between the recess portion 52*b* disposed between the conveyance nips N1 and N1 in the width direction W and the conveyance nips N1 and N1, and the leading edge Sa of the sheet S has a wavy shape. The leading edge Sa enters the recess portion 52*b*.

As described above, the leading edge Sa of the sheet S is sandwiched between the conveyance nip N1 and the protrusion portion 114*a* displaced in the width direction W and the thickness direction of the sheet, so that the leading edge Sa of the sheet S becomes a wavy shape.

Further, since the sheet S is conveyed by the conveyance unit 4 even while the movement in the sheet conveyance direction CD is restricted by the conveyance nip N1, a loop is formed upstream of the leading edge Sa in the sheet conveyance direction CD. However, in the present embodiment, as described above, the cross section secondary moment of the sheet S is increased by waving the leading edge Sa of the sheet S, and the rigidity is temporarily improved. Therefore, even if the leading edge Sa is conveyed by the conveyance unit 4 in a state where the leading edge Sa is dammed by the conveyance nip N1, it is difficult to form a loop on the sheet S. That is, even if the registration roller pair 51 is stopped for the same time as the related art, the loop is less likely to be formed on the sheet S in the present embodiment than in the related art.

Figure 16C:
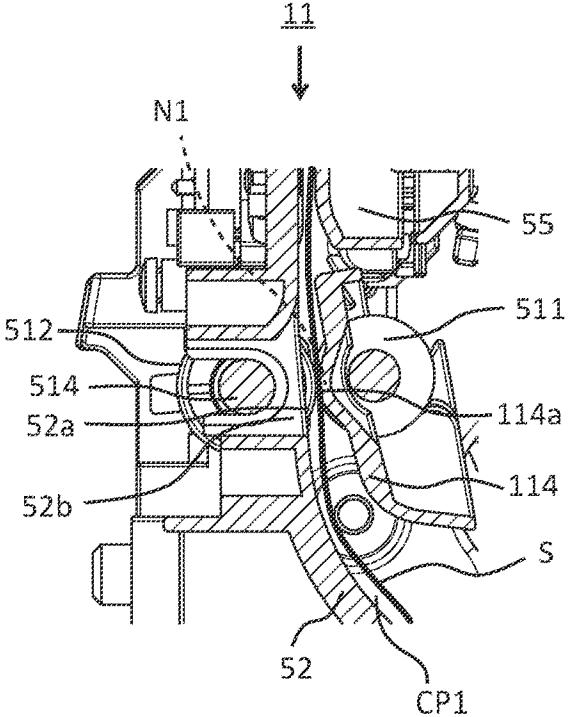
FIG. 16C is a cross-sectional view illustrating a state in which the sheet is conveyed by a registration roller pair.

As illustrated in FIG. 16C, the registration roller pair 51 started to be driven by the control unit 95 conveys the sheet S. At this time, the loop of the sheet S does not abut on the registration frame 52, the swing guide 114, and the like. Therefore, the skew returning caused by the reaction force applied to the sheet S from the conveyance guide can be reduced, and the skew correction can be satisfactorily performed. While the sheet S is passing through the conveyance nip N1, the swing guide 114 is pressed against the surface of the sheet S and moves to open the conveyance path CP1. That is, the swing guide 114 swings so that the protrusion portion 114*a* is separated from the recess portion 52*b*. When the trailing edge of the sheet S passes through the protrusion portion 114*a*, the swing guide 114 returns to the standby position by the torsion coil spring 115.

As described above, in the present embodiment, by waving the leading edge Sa of the sheet S, the rigidity of the sheet S itself can be temporarily improved, and the loop formed on the sheet S at the time of skew correction can be reduced. Accordingly, the skew returning can be reduced, and the skew of the sheet can be satisfactorily corrected. In addition, the print image accuracy can be improved, and a good product can be obtained. In particular, for example, a sheet having a small grammage such as thin paper tends to have a large loop formed at the time of the skew correction, but according to the present embodiment, the skew can be satisfactorily corrected regardless of the grammage of the sheet. Furthermore, since the present embodiment has a simple configuration, the skew of the sheet can be corrected with an inexpensive configuration.

In the present embodiment, the swing guide 114 is swingably attached to the registration frame 52, but the present invention is not limited thereto. For example, the swing guide 114 may be mounted to be linearly movable with respect to the registration frame 52.

OTHER EMBODIMENTS

In any of the embodiments described above, each of the conveyance roller pair 41 and the registration roller pair 51 is constituted by a roller, but the present invention is not limited thereto. For example, some or all of the conveyance roller pair 41 and the registration roller pair 51 may be formed of another rotating member such as a belt.

In the first and second embodiments, the guide surface 52*a* and the recess portion 52*b* are provided in the registration frame 52, but the present invention is not limited thereto. For example, the guide surface 52*a* and the recess portion 52*b* may be provided in a member different from the registration frame 52. In the first embodiment, the skew correction member 531 is supported by the registration frame 52, but may be supported by another member.

In any of the embodiments described above, the electrophotographic printer 1 has been described, but the present invention is not limited thereto. For example, the present invention can also be applied to an inkjet type image forming apparatus that forms an image on a sheet by ejecting ink liquid from a nozzle. In addition, the above-described embodiments and modifications may be arbitrarily combined.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-064386, filed Apr. 8, 2022, which is hereby incorporated by reference herein in its entirety.

What is claimed is:

1. A sheet conveyance apparatus comprising:

a conveyance rotating member pair configured to convey a sheet in a sheet conveyance direction;

a skew correction portion including a first abutment surface against which a leading edge of the sheet conveyed by the conveyance rotating member pair abuts, and a second abutment surface that is disposed at a position different from the first abutment surface in a width direction orthogonal to the sheet conveyance direction, the leading edge of the sheet abutting against the first abutment surface and the second abutment surface in a case where a skew of the sheet is corrected wherein the first abutment surface includes a first root portion, wherein the second abutment surface includes a second root portion; and a guide portion that guides the sheet conveyed by the conveyance rotating member pair toward the first abutment surface and the second abutment surface, wherein the guide portion includes:

a guide surface that is disposed between the first abutment surface and the second abutment surface in the width direction and forms a conveyance path through which a sheet passes;

a first recess portion that is formed at the guide portion and disposed upstream of the first abutment surface in the sheet conveyance direction, is disposed at a position overlapping with the first abutment surface in the width direction, and is recessed to an opposite side to the conveyance path with respect to the guide surface; and a second recess portion that is formed at the guide portion and disposed upstream of the second abutment surface in the sheet conveyance direction, is disposed at a position overlapping with the second abutment surface in the width direction, and is recessed to the opposite side to the conveyance path with respect to the guide surface, wherein the first root portion is positioned within the first recess portion such that the leading edge of the sheet enters the first recess portion upon abutting against both the first abutment surface and the second abutment surface, and wherein the second root portion is positioned within the second recess portion such that the leading edge of the sheet enters the second recess portion upon abutting against both the first abutment surface and the second abutment surface.

2. The sheet conveyance apparatus according to claim 1, wherein the skew correction portion is biased to a standby position where the first abutment surface and the second abutment surface protrude to the conveyance path, the first abutment surface is an inclined surface that is inclined, when viewed in the width direction, so as to approach the first recess portion in a thickness direction of the sheet as the first abutment surface extends downstream in the sheet conveyance direction in a case where the skew correction portion is located at the standby position, and the second abutment surface is an inclined surface inclined, when viewed in the width direction, so as to approach the second recess portion in the thickness direction of the sheet as the second abutment surface extends downstream in the sheet conveyance direction in a case where the skew correction portion is located at the standby position.

3. The sheet conveyance apparatus according to claim 2, further comprising an opposing guide portion having an opposing guide surface that forms the conveyance path together with the guide surface, the opposing guide portion facing the guide portion, wherein the first abutment surface protrudes more inward of the opposing guide portion than the opposing guide surface and enters an inside of the first recess portion when viewed in the width direction in a case where the skew correction portion is located at the standby position, and the second abutment surface protrudes more inward of the opposing guide portion than the opposing guide surface and enters an inside of the second recess portion when viewed in the width direction in a case where the skew correction portion is located at the standby position.

4. The sheet conveyance apparatus according to claim 2, wherein the skew correction portion is swingably supported by the guide portion.

5. The sheet conveyance apparatus according to claim 2, further comprising a rotating member pair that includes a conveyance nip disposed downstream of the first abutment surface and the second abutment surface of the skew correction portion located at the standby position in the sheet conveyance direction, the rotating member pair conveying a sheet, wherein the skew correction portion is supported so as to be rotatable about a rotation shaft of either one rotating member of the rotating member pair.

6. The sheet conveyance apparatus according to claim 1, wherein the skew correction portion further includes:

a first abutment member including the first abutment surface;

a second abutment member including the second abutment surface;

a connecting member connecting the first abutment member and the second abutment member; and a biasing portion biasing the skew correction portion to a standby position such that the first abutment surface and the second abutment surface protrude to the conveyance path, and wherein the first abutment surface and the second abutment surface retreat from the conveyance path against a biasing force of the biasing portion by being pressed by the leading edge of the sheet conveyed by the conveyance rotating member pair.

7. The sheet conveyance apparatus according to claim 1, wherein the skew correction portion includes a third abutment surface and a fourth abutment surface that are disposed so as to sandwich the first abutment surface and the second abutment surface in the width direction, the leading edge of the sheet conveyed by the conveyance rotating member pair abutting against the third abutment surface and the fourth abutment surface in a case where a skew of the sheet is corrected, and the third abutment surface and the fourth abutment surface are positioned upstream of the first abutment surface and the second abutment surface in the sheet conveyance direction.

8. The sheet conveyance apparatus according to claim 1, wherein a loop formed on the sheet by being conveyed by the conveyance rotating member pair in a state of abutting against the first abutment surface and the second abutment surface does not abut on the guide portion.

9. An image forming apparatus, comprising:

the sheet conveyance apparatus according to claim 1; and an image forming unit configured to form an image on a sheet conveyed by the sheet conveyance apparatus.

10. The sheet conveyance apparatus according to claim 1, wherein the skew correction portion is configured to swing around a swing axis, wherein the guide surface is disposed on a same side as the swing axis with respect to the conveyance path, wherein an end, opposite to the first root portion, of the first abutment surface is disposed on a side opposite to the swing axis across the conveyance path, and wherein an end, opposite to the second root portion, of the second abutment surface is disposed on the side opposite to the swing axis across the conveyance path.

11. A sheet conveyance apparatus comprising:

a conveyance rotating member pair configured to convey a sheet in a sheet conveyance direction;

a skew correction portion including a first rotating member pair having a first nip against which a leading edge of the sheet conveyed by the conveyance rotating member pair abuts, and a second rotating member pair disposed at a position different from the first rotating member pair in a width direction orthogonal to the sheet conveyance direction and having a second nip, the leading edge of the sheet abutting against the first nip and the second nip in a case where a skew of the sheet is corrected; and a guide portion that guides the sheet conveyed by the conveyance rotating member pair toward the first nip and the second nip, wherein the guide portion includes:

a guide surface that forms a conveyance path through which a sheet passes; and a recess portion that is formed at the guide portion and disposed upstream of the first nip and the second nip in the sheet conveyance direction and between the first nip and the second nip in the width direction, and is recessed to an opposite side to the conveyance path with respect to the guide surface, and wherein the recess portion is configured such that, in operation of the sheet conveyance apparatus, a leading edge, abutting against the first nip and the second nip, of the sheet conveyed by the conveyance rotating member pair enters the recess portion.

12. The sheet conveyance apparatus according to claim 11, wherein the skew correction portion further includes a swing guide that is swingably provided and is biased to a standby position, the swing guide including a protrusion portion that enters the recess portion in a case where the swing guide is positioned at the standby position.

13. The sheet conveyance apparatus according to claim 12, wherein the protrusion portion includes an inclined surface that is inclined so as to approach the recess portion in a thickness direction of the sheet as the inclined surface extends downstream in the sheet conveyance direction when viewed in the width direction in a case where the swing guide is located at the standby position.

14. The sheet conveyance apparatus according to claim 13, wherein the swing guide swings by being pressed by the sheet conveyed by the first nip and the second nip such that the protrusion portion is separated from the recess portion.

15. The sheet conveyance apparatus according to claim 11, wherein a loop formed on the sheet by being conveyed by the conveyance rotating member pair in a state of abutting against the first nip and the second nip does not abut on the guide portion.

16. A sheet conveyance apparatus comprising:

a conveyance rotating member pair configured to convey a sheet in a sheet conveyance direction;

a skew correction portion including an abutment surface, a leading edge of the sheet conveyed by the conveyance rotating member pair abutting against the abutment surface in a case where a skew of the sheet is corrected; and a guide portion that guides the sheet conveyed by the conveyance rotating member pair toward the abutment surface, wherein the abutment surface includes a root portion, wherein the guide portion includes:

a first guide surface that is disposed on a first side with respect to the abutment surface in a width direction orthogonal to the sheet conveyance direction and forms a conveyance path through which the sheet passes;

a second guide surface that is disposed on a second side with respect to the abutment surface in the width direction and forms the conveyance path; and a recess portion that is formed at the guide portion and disposed upstream of the abutment surface in the sheet conveyance direction, is disposed at a position overlapping with the abutment surface in the width direction, and is recessed to an opposite side to the conveyance path with respect to the first guide surface and the second guide surface, and wherein the root portion is positioned within the recess portion such that the leading edge of the sheet enters the recess portion upon abutting against the abutment surface.

17. The sheet conveyance apparatus according to claim 16, wherein the first guide surface and the second guide surface are disposed so as to overlap each other when viewed in the width direction.

18. The sheet conveyance apparatus according to claim 16, wherein the skew correction portion is configured to swing around a swing axis, wherein the first guide surface and the second guide surface is disposed on a same side as the swing axis with respect to the conveyance path, and wherein an end, opposite to the root portion, of the abutment surface is disposed on a side opposite to the swing axis across the conveyance path.

* * * * *